US010286661B2

(12) United States Patent
Kasai et al.

(10) Patent No.: US 10,286,661 B2
(45) Date of Patent: May 14, 2019

(54) LIQUID DISCHARGE METHOD AND LIQUID DISCHARGE APPARATUS FOR HEATING A LIQUID THROUGH A SURFACE TO GENERATE A BUBBLE

(71) Applicant: CANON KABUSHIKI KAISHA, Tokyo (JP)

(72) Inventors: Shintaro Kasai, Yokohama (JP); Yoshiyuki Nakagawa, Kawasaki (JP); Akira Shibasaki, Soka (JP); Masataka Sakurai, Kawasaki (JP); Ken Tsuchii, Sagamihara (JP); Akiko Hammura, Tokyo (JP); Tatsurou Mori, Yokohama (JP); Shinji Kishikawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/792,391

(22) Filed: Oct. 24, 2017

(65) Prior Publication Data

US 2018/0117913 A1 May 3, 2018

(30) Foreign Application Priority Data

Oct. 27, 2016 (JP) ..... 2016-211023
Jan. 31, 2017 (JP) ..... 2017-016212

(51) Int. Cl.
*B41J 2/14* (2006.01)
*B41J 2/045* (2006.01)

(52) U.S. Cl.
CPC ..... *B41J 2/14088* (2013.01); *B41J 2/0451* (2013.01); *B41J 2/0458* (2013.01); *B41J 2/04516* (2013.01); *B41J 2/04563* (2013.01); *B41J 2/04591* (2013.01); *B41J 2/04598* (2013.01); *B41J 2/14032* (2013.01); *B41J 2002/14169* (2013.01); *B41J 2002/14177* (2013.01); *B41J 2002/14185* (2013.01); *B41J 2002/14338* (2013.01); *B41J 2002/14467* (2013.01)

(58) Field of Classification Search
CPC ..... B41J 2/14088; B41J 2/04516
See application file for complete search history.

(56) References Cited

U.S. PATENT DOCUMENTS 6,582,060 B1 * 6/2003 Kitakami ..... B41J 2/1404 347/56

FOREIGN PATENT DOCUMENTS

JP 11-188870 A 7/1999

* cited by examiner

*Primary Examiner* — Henok D Legesse
(74) *Attorney, Agent, or Firm* — Canon U.S.A., Inc. IP Division

(57) ABSTRACT

Disclosed is a liquid discharge method of discharging liquid with a liquid discharge head having a heating surface that contacts and heats the liquid and a discharge port that faces the heating surface and discharges the liquid. The method includes heating the liquid through the heating surface to generate a bubble such that the bubble communicates with an atmosphere, thereby discharging the liquid. The liquid that is being discharged from the discharge port includes a trailing portion. The trailing portion moves toward the heating surface in response to a reduction in volume of the bubble and contacts the heating surface. The method further includes heating the trailing portion through the heating surface while the trailing portion is in contact with the heating surface, thereby generating a bubble.

22 Claims, 17 Drawing Sheets

FIG. 2A
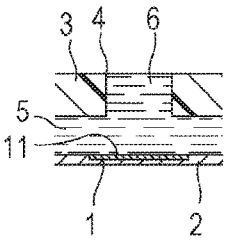
FIG. 2B
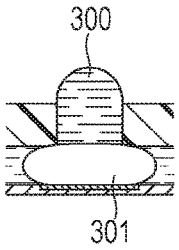
FIG. 2C
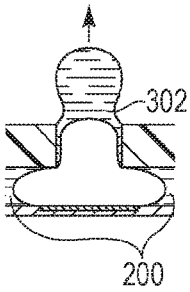
FIG. 2D
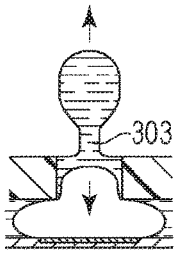
FIG. 2E
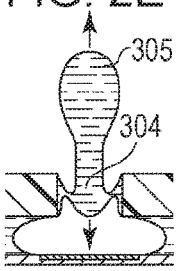
FIG. 2F
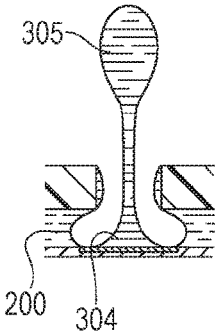
FIG. 2G
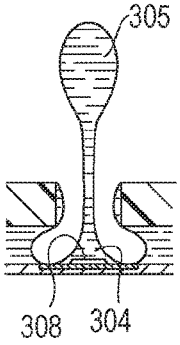
FIG. 2H
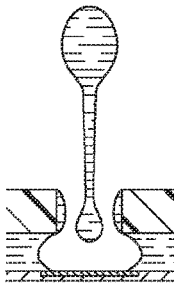
FIG. 2I
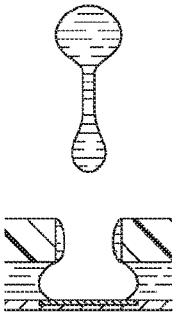
FIG. 2H2
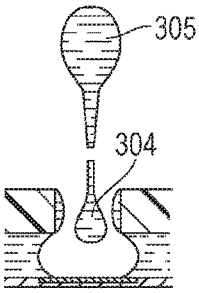

FIG. 16A1
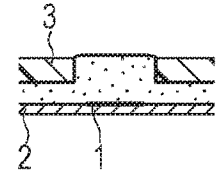
FIG. 16A2
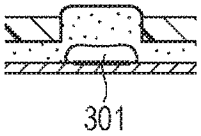
FIG. 16A3
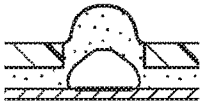
FIG. 16A4
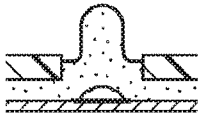
FIG. 16A5
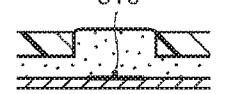
FIG. 16B1
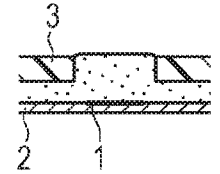
FIG. 16B2
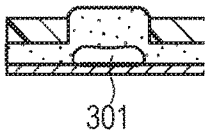
FIG. 16B3
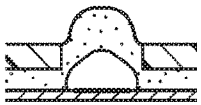
FIG. 16B4
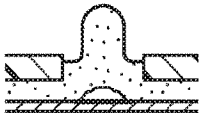
FIG. 16B5
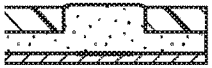
FIG. 16C1
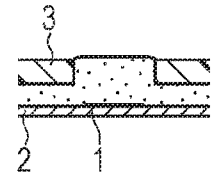
FIG. 16C2
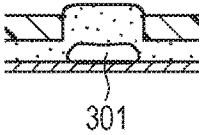
FIG. 16C3
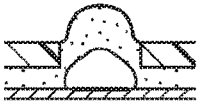
FIG. 16C4
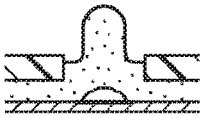
FIG. 16C5
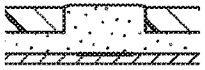
FIG. 16C6
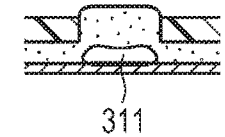
FIG. 16C7
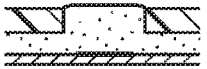

LIQUID DISCHARGE METHOD AND LIQUID DISCHARGE APPARATUS FOR HEATING A LIQUID THROUGH A SURFACE TO GENERATE A BUBBLE

BACKGROUND OF THE INVENTION

Field of the Invention

The present disclosure relates to a liquid discharge method and a liquid discharge apparatus.

Description of the Related Art

When liquid is discharged by using a liquid discharge method typified by inkjet printing technology, the discharged liquid is column-shaped and includes a main droplet and a long droplet tail following and extending from the main droplet. While the liquid is being elected, the surface tension of the liquid causes the droplet tail to separate from the main droplet, so that the droplet tail turns into a small droplet (satellite droplet). The satellite droplet may be applied to a position different from that of the main droplet on a printing medium, leading to a reduction in image quality.

A liquid discharge method known in the art includes applying thermal energy to liquid through a heating surface to generate a bubble such that the bubble is allowed to communicate with an atmosphere during reduction of the volume of the bubble, thereby discharging the liquid (refer to Japanese Patent Laid-Open No. 11-188870). FIGS. 8A-8H are sectional views illustrating steps of liquid discharge to which this liquid discharge method is applied. According to this method, a trailing portion of discharged liquid has a velocity component pointing to a heating surface 11, so that the portion that may become satellite droplets tend to be separated from a main droplet within a discharge port. Consequently, the trailing portion does not tend to be ejected as satellite droplets from the discharge port.

According to the liquid discharge method disclosed in Japanese Patent Laid-Open No. 11-188870, the trailing portion of the liquid contacts the heating surface 11 (FIG. 8F) and the liquid is then separated at its part at which a velocity component pointing in a liquid discharging direction is substantially zero, so that the liquid is ejected (FIG. 8G). A trailing portion of the liquid that is being elected has a lower velocity than a main droplet of the liquid. Disadvantageously, there is still the likelihood that satellite droplets may be generated from the trailing portion separated from the main droplet of the liquid.

SUMMARY OF THE INVENTION

The present disclosure provides a liquid discharge method capable of further reducing satellite droplets.

The present disclosure provides a liquid discharge method of discharging liquid with a liquid discharge head having a heating surface that contacts and heats the liquid and a discharge port that faces the heating surface and discharges the liquid. The method includes heating the liquid through the heating surface to generate a bubble such that the bubble communicates with an atmosphere, thereby discharging the liquid. The liquid that is being discharged from the discharge port includes a trailing portion, the trailing portion moves toward the heating surface in response to a reduction in volume of the bubble, and the trailing portion contacts the heating surface. The method further includes heating the trailing portion through the heating surface while the trailing portion is in contact with the heating surface, thereby generating a bubble.

According to the present disclosure, while the trailing portion of the liquid that is being discharged from the discharge port is in contact with the heating surface, the trailing portion of the liquid is heated through the heating surface, thereby generating a bubble. The generated bubble presses the trailing portion of the liquid in a direction in which the liquid is discharged, so that a satellite droplet does not tend to be generated. According to the present disclosure, therefore, satellite droplets can be further reduced.

Further features of the present disclosure will become apparent from the following description of exemplary embodiments with reference to the attached drawings.

BRIEF DESCRIPTION OF THE DRAWINGS

FIGS. 2A-2H, 2H2 and 2I are diagrams illustrating steps of liquid discharge to which the liquid discharge method according to the present disclosure is applied.

FIGS. 16A1-16A5, 16B1-16B5 and 16C1-16C7 are diagrams illustrating transitions from bubble generation to bubble dissipation in a discharge failure state.

DESCRIPTION OF THE EMBODIMENTS

Embodiments of the present disclosure will be described below with reference to the drawings. A liquid discharge method according to the present disclosure can be applied to an ink discharge method with an inkjet head. Furthermore, the method can be applied to a variety of industrial liquid discharge methods of discharging liquid other than ink. A liquid discharge head in the following embodiments is of a serial scan type. The liquid discharge head may be of a line type.

First Embodiment

Configuration of Liquid Discharge Apparatus

Figure 9:
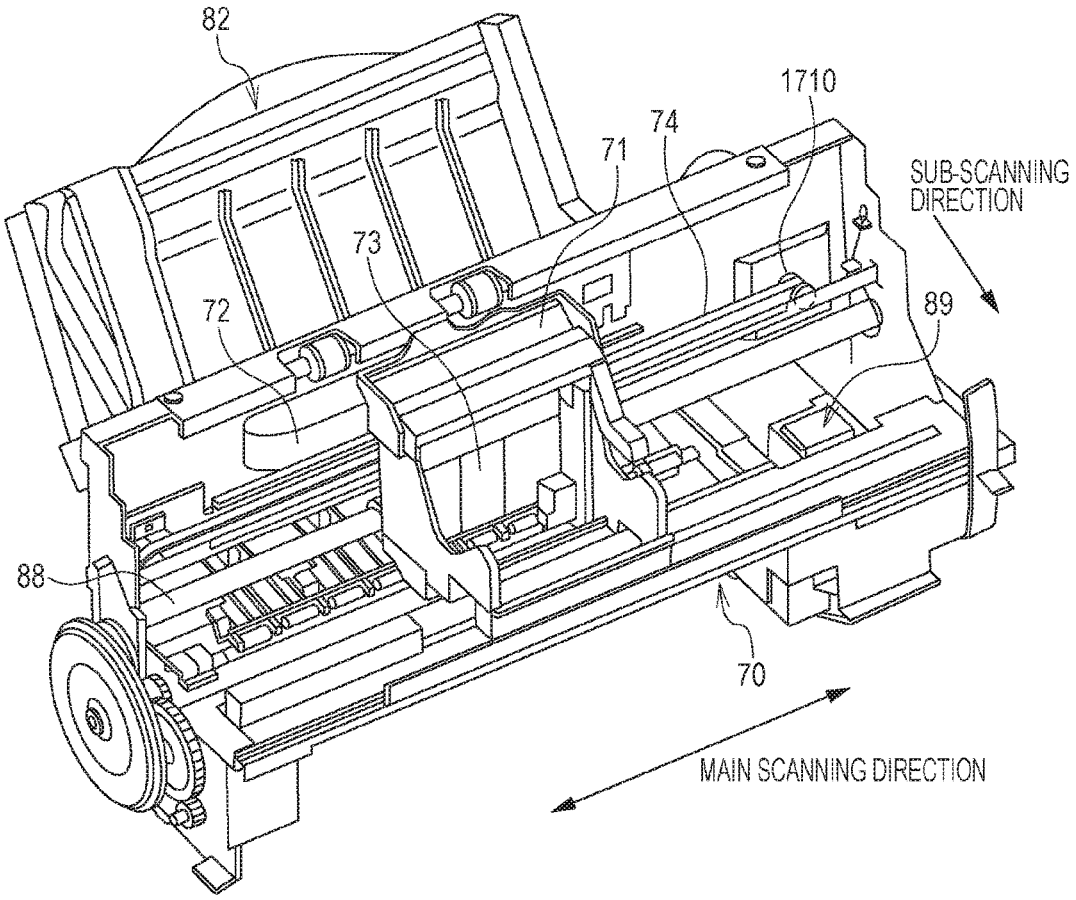
FIG. 9 is a perspective view of an exemplary liquid discharge apparatus to which the liquid discharge method according to the present disclosure can be applied.

FIG. 9 is a perspective view of an exemplary liquid discharge apparatus (inkjet printer) to which the present disclosure can be applied. A printer 70, which is of the serial scan type, causes a liquid discharge head to scan (main-scan) a printing medium in a direction (main scanning direction) orthogonal to a conveying direction, in which the printing medium is conveyed, for image formation.

The configuration of the printer 70 and its liquid discharge operation will be described in brief. A printing medium (not illustrated) fed from an auto sheet feeder (ASE) 82 is conveyed (sub-scanned) to a printing position by a sheet feeding roller (not illustrated) driven by a sheet feeding motor (not illustrated) via a gear mechanism (not illustrated). In a predetermined conveyance position, a carriage 71 is moved along a guide shaft 88 extending in a direction orthogonal to the conveying direction by a timing belt 71 driven by a carriage motor 1710. During movement of the carriage 71, discharge ports 4 of a liquid discharge head 12 detachably mounted on the carriage 71 are caused to discharge liquid, thus achieving printing having a predetermined band width corresponding to an array of the discharge ports 4. Then, the printing medium is conveyed and printing for the next band width is performed.

A flexible cable 72 for supplying a signal to drive the liquid discharge head 12 mounted on the carriage 71 is attached to the carriage 71. A first end of the flexible cable 72 is connected to a substrate 73 with contact pins disposed on a liquid-discharge-head mounting portion of the carriage 71. A second end of the flexible cable 72 is connected to a control circuit (not illustrated) that executes control for the printer. A recovery system unit 89 for performing recovery processing of the liquid discharge head is disposed in part of a movable range of the carriage 71, for example, at a home position of the liquid discharge head.

Control Mechanism of Liquid Discharge Apparatus

A mechanism for executing control for the liquid discharge apparatus to which the present disclosure can be applied will now be described.

Figure 10:
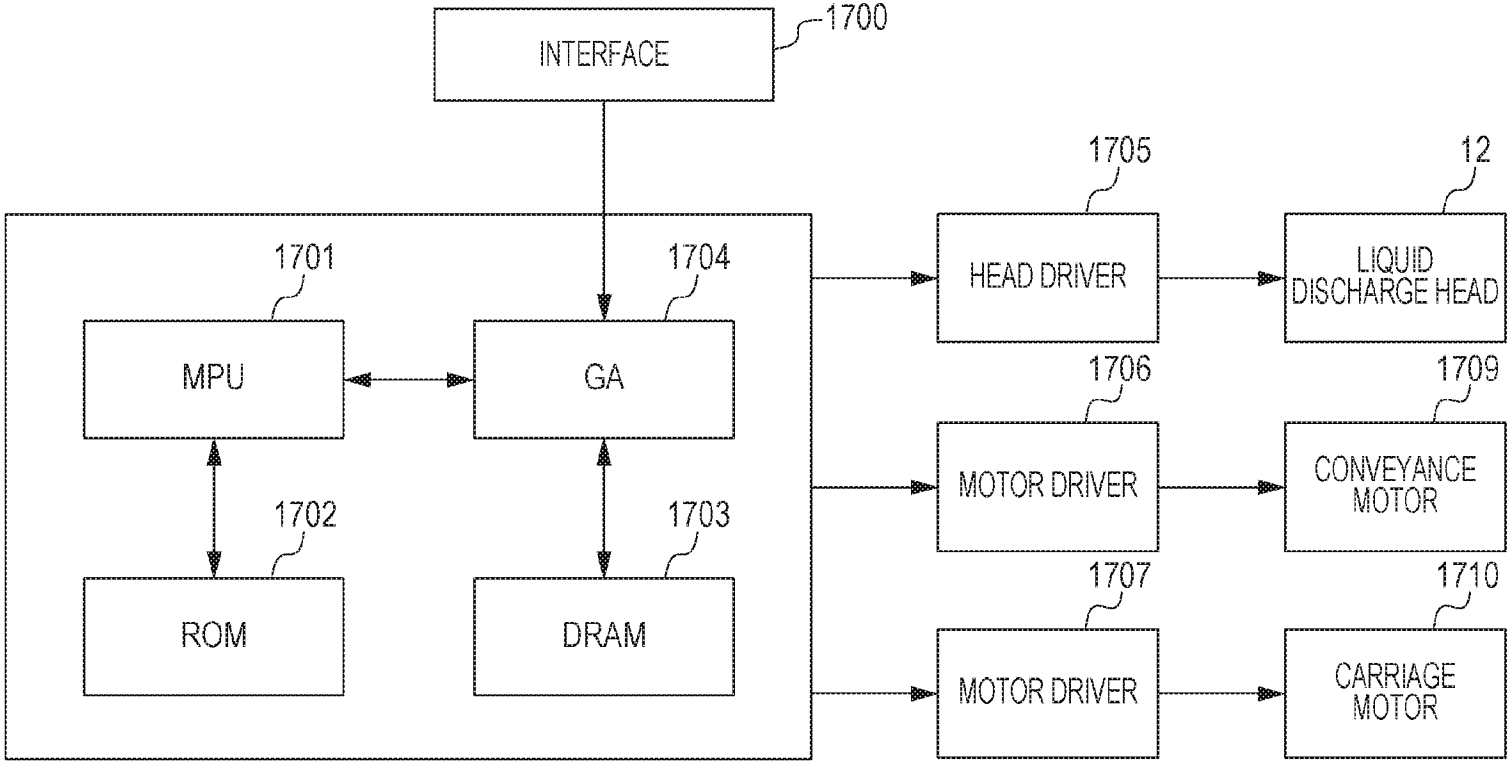
FIG. 10 is a block diagram illustrating an exemplary configuration of a control circuit of the liquid discharge apparatus to which the liquid discharge method according to the present disclosure can be applied.

FIG. 10 is a block diagram illustrating an exemplary configuration of a control circuit of the liquid discharge apparatus. As illustrated in FIG. 10, the control circuit includes an interface 1700 through which a discharge signal input, a micro processing unit (MPU) 1701, a read-only memory (ROM) 1702 that stores a control program, which the MPU 1701 runs, a dynamic random access memory (DRAM) 1703 that stores various data items (e.g., the above-described discharge signal and print data to be supplied to the liquid discharge head 12), and a gate array (GA) 1704 that controls the supply of the print data to the liquid discharge head 12 and also controls data transfer between the interface 1700, the MPU 1701, and the DRAM 1703. The control circuit further includes a head driver 1705, serving as a driving unit. The head driver 1705 drives heaters 1, serving as heating portions, for liquid discharge. The heaters 1 are included in the liquid discharge head 12. The control circuit further includes a motor driver 1706 and a motor driver 1707, which drive a conveyance motor 1709 and the carriage motor 1710, respectively.

An operation of the above-described control circuit will now be described. When the interface 1700 receives a discharge signal, a print signal is converted into print data between the GA 1704 and the MPU 1701. The motor drivers 1706 and 1707 are driven. In addition, the heaters 1 are driven in accordance with the print data transmitted to the head driver 1705, so that the liquid is discharged to achieve printing.

In the above description, the control program that the MPU 1701 runs is stored in the ROM 1702. In one or more embodiments, the control circuit further includes an erasable and writable storage medium, such as an electrically erasable programmable ROM (EEPROM), such that the control program can be modified by a computer connected to the liquid discharge apparatus.

Configuration of Liquid Discharge Head

Figure 5:
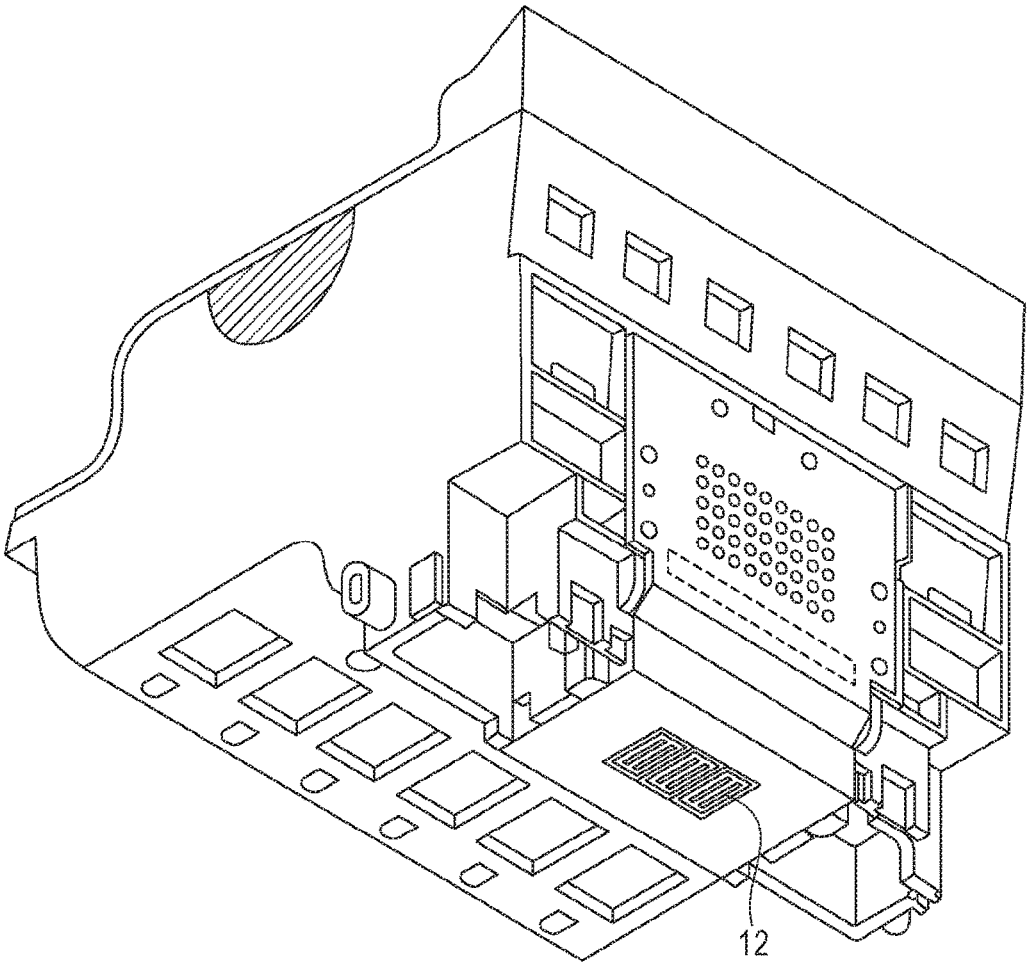
FIG. 5 is a perspective view of a head cartridge including a liquid discharge head to which the liquid discharge method according to the present disclosure can be applied.
Figure 6A:
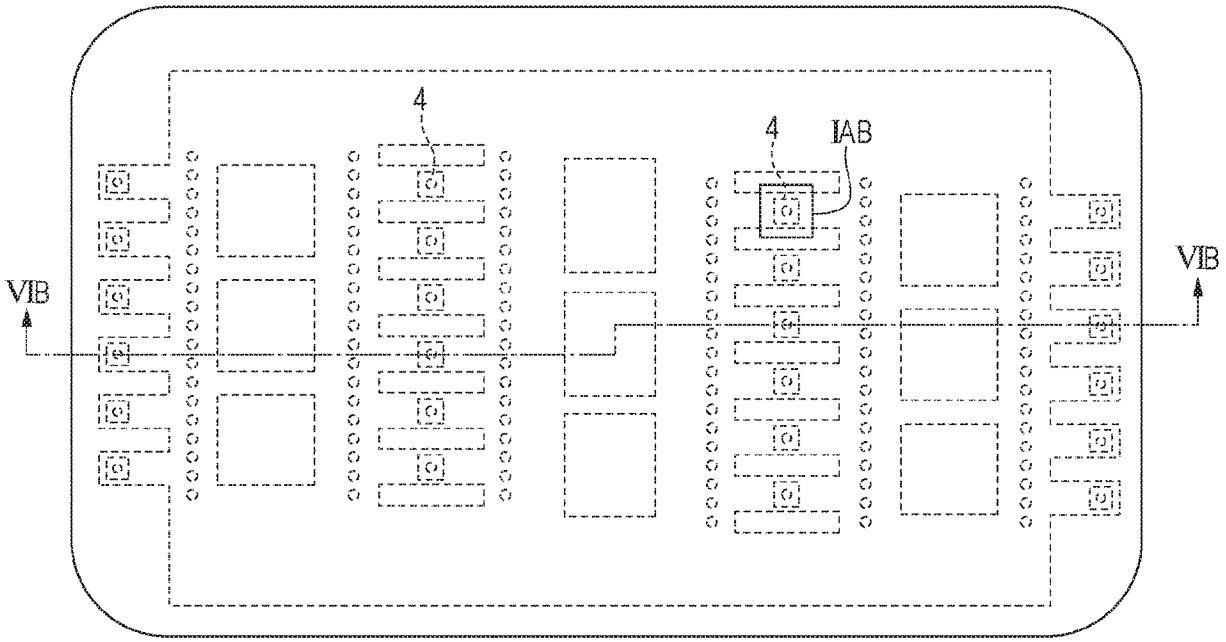
FIGS. 6A and 6B are diagrams illustrating a liquid discharge head to which the liquid discharge method according to the present disclosure can be applied, FIG. 6A being a plan view of the liquid discharge head, FIG. 6B being a cross-sectional view of the head taken along line VIB-VIB in FIG. 6A.
Figure 6B:
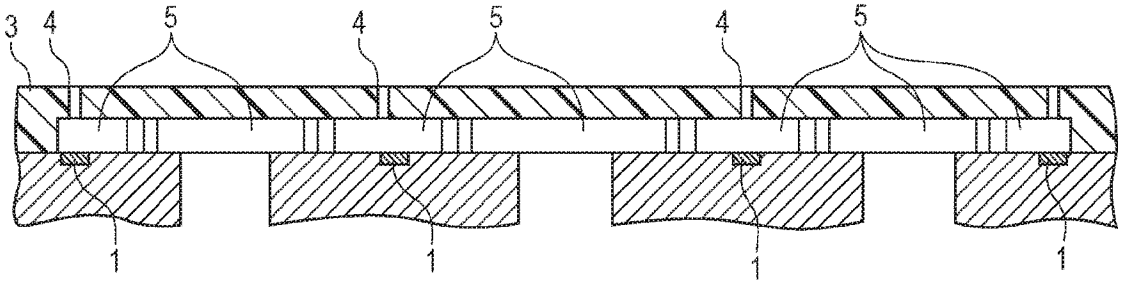

FIG. 5 is a perspective view of a head cartridge including the liquid discharge head 12 to which the liquid discharge method according to the present disclosure can be applied. FIG. 6A is a plan view of the liquid discharge head as viewed from a side to which the liquid is discharged. FIG. 6B is a sectional view taken along line VIB-VIB in FIG. 6A.

Figure 1A:
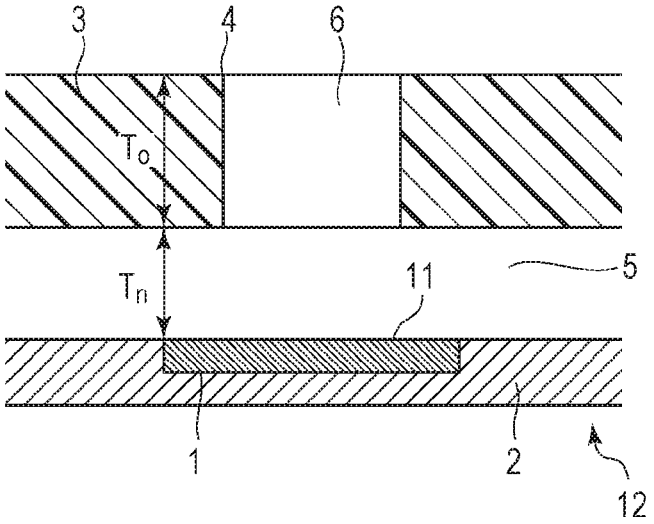
FIGS. 1A and 1B are schematic diagrams illustrating a liquid discharge head in a first embodiment to which a liquid discharge method according to the present disclosure can be applied, FIG. 1A being a sectional view of the liquid discharge head, FIG. 1B being a plan view of the head of FIG. 1A.
Figure 1B:
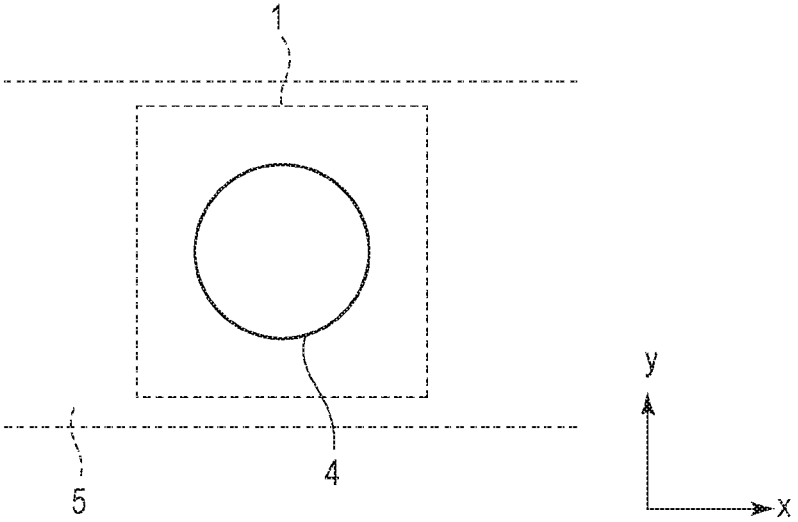

FIGS. 1A and 1B are enlarged views of part IAB of the liquid discharge head 12 in FIG. 6A and schematically illustrate an exemplary configuration of the liquid discharge head 12. FIG. 1A is a sectional view of the liquid discharge head. FIG. 1B is a plan view of the head of FIG. 1A as viewed from the side to which the liquid is discharged.

As illustrated in FIG. 1A, a channel 5 through which the liquid flows is defined by an element substrate 2 and an orifice plate 3, which is disposed above the element substrate 2 and is molded of resin. In view of a channel resistance in the channel 5 in the first embodiment, a height $T_n$ of the channel 5, or a distance between an upper surface of the element substrate 2 and a lower surface of the orifice plate 3 is preferably 5 μm or greater. Furthermore, in view of the strength of the orifice plate 3, a thickness $T_o$ of the orifice plate 3 is preferably 3 μm or greater.

In addition, the heater 1, which serves as a heating portion and is rectangular, is disposed on the element substrate 2. The heater 1 is constituted by part of a heat generating resistor layer. This part is disposed between two electrodes. The heater 1 generates thermal energy, which is applied to the liquid through a heating surface 11. There are two types of configuration of the heater 1: (1) the heater 1 has an upper surface covered with a film, such as a protective film; and (2) the heater 1 has an upper surface with no cover. In the configuration (1), an upper surface of the protective film covering the heater 1 and contacting the liquid serves as the heating surface 11 and heats the liquid. In the configuration (2), the upper surface of the heater 1 contacting the liquid serves as the heating surface 11 and heats the liquid.

The orifice plate 3 has discharge ports 4, each of which serves as a circular opening and is located so as to face the heater 1, and includes discharge port portions 6, each of which extends from the channel 5 to the discharge port 4 and is column-shaped. Each discharge port 4 is configured such that the center of gravity of the discharge port 4 is aligned with the center of gravity of the heating surface 11 in a liquid discharging direction. In the first embodiment, the shape of the discharge port is circular. The discharge port may have any other shape. In one or more embodiments, the discharge port has a rectangular shape. Furthermore, it is only required that the discharge port 4 overlaps the heating surface 11 in the liquid discharging direction. A configuration in which the center of gravity of the discharge port 4 is not aligned with the center of gravity of the heating surface 11 may be used.

Figure 4A:
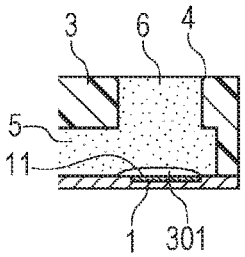
FIGS. 4A-4H are diagrams illustrating steps of liquid discharge in a liquid discharge head in another embodiment to which the liquid discharge method according to the present disclosure is applied.
Figure 4B:
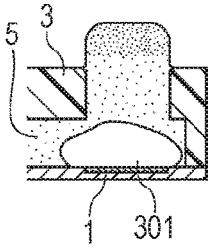
Figure 4C:
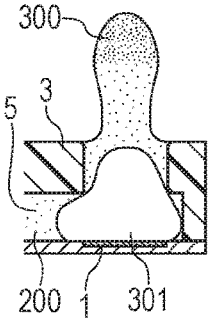
Figure 4D:
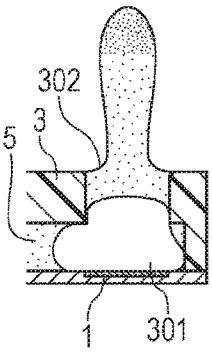
Figure 4E:
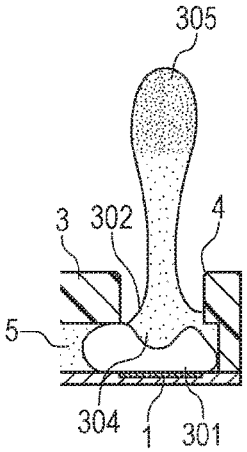
Figure 4F:
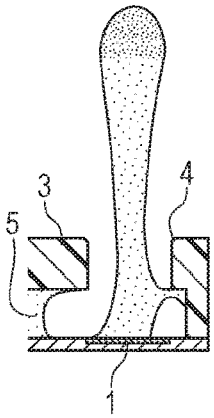
Figure 4G:
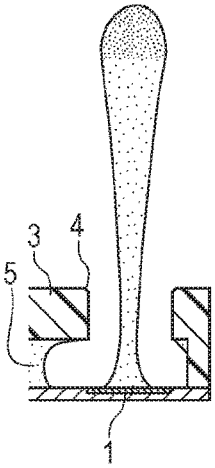
Figure 4H:
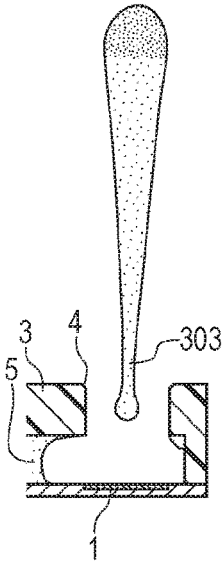

As illustrated in FIG. 1B, the channel 5 extends in the x direction symmetrically with respect a plane that extends in the liquid discharging direction and includes the center of gravity of the discharge port 4. The liquid is supplied to the discharge port 4 through the discharge port portion 6 from the channel 5 such that the liquid flows from both directions into the discharge port portion 6. The channel may have any other configuration. As illustrated in FIG. 4A, the liquid may be supplied to the discharge port from a channel such that the liquid flows from one direction into the discharge port portion.

Liquid Discharge Method

FIGS. 2A-2H, 2H2 and 2I illustrate steps of liquid discharge to which the liquid discharge method according to the present disclosure is applied. First, die heater 1 is driven to cause the heating surface 11 to heat the liquid on the heating surface 11, thus generating a bubble 301. The generation of the bubble 301 produces pressure, which presses the liquid in the liquid discharging direction (FIG. 2B). At this time, the heating surface 11 is covered with the bubble 301. As illustrated in. FIG. 2C, the bubble 301 increases in volume and enters the discharge port portion 6, so that the bubble 301 separates the liquid that is being discharged (hereinafter, referred to as "discharge liquid 300") from channel liquid 200 in the channel. After the bubble 301 grows and reaches a maximum volume, the volume begins to decrease. As the bubble 301 collapses, a trailing portion 304 of the discharge liquid moves toward the heating surface 11 (FIG. 2D). At this time, a leading portion (main droplet) 305 of the discharge liquid differs in velocity in the liquid discharging direction from the trailing portion 304 thereof, thus forming a droplet tail 303 of the discharge liquid 300. When a meniscus 302 of the discharge liquid is drawn toward the heating surface 11 at a velocity higher than a velocity at which the bubble 301 collapses, the bubble 301 communicates with an atmosphere, so that the trailing portion 304 of the discharge liquid contacts the heating surface 11, as illustrated in FIG. 2F, and spreads over the heating surface 11.

In a state of FIG. 2F, the heater 1 is driven, thereby causing the heating surface 11 to heat the trailing portion 304 of the liquid in contact with the heating surface 11. Consequently, the trailing portion 304 is partially evaporated, thus generating a bubble 308. The generation of the bubble 308 produces pressure, which presses the trailing portion 304 in the liquid discharging direction (to the leading portion 305 of the discharge liquid 300). The discharge liquid 300 with the trailing portion 304 having a velocity component in this direction is discharged from the discharge port 4 (FIGS. 2H and 2I). This reduces the difference in velocity between the leading portion 305 and the trailing portion 304 of the liquid, resulting in a reduction in length of the droplet tail 303. Thus, a satellite droplet does not tend to be generated. Satellite droplets can be further reduced. The term "satellite droplet" as used herein refers to a liquid droplet having an enough size to land on a printing medium.

To efficiently increase the velocity of the trailing portion 304 in contact with the heating surface 11 (FIG. 2F) by driving the heater 1, the discharge liquid 300 can have a proper volume for the following reasons.

A small volume of the discharge liquid 300 results in a small area of contact between the trailing portion 304 of the liquid and the heating surface 11. If the trailing portion 304 is heated in such a state, it would be difficult to cause the trailing portion 304 to have a velocity component toward the leading portion 305.

A large volume of the discharge liquid 300 may cause the discharge liquid 300 to contact the channel liquid 200. If the discharge liquid 300 contacts the channel liquid 200, the discharge liquid 300 would have to be separated from the channel liquid 200.

To allow the discharge liquid 300 to have a proper volume, the thickness $T_o$ of the orifice plate 3, the height $T_n$ of the channel 5, and the magnitude of thermal energy for liquid discharge can be properly adjusted. Adjusting the height $T_n$ of the channel 5 and/or the thermal energy from the heater 1 enables the discharge liquid 300 to experience a state where the bubble 301 separates the discharge liquid 300 from the channel liquid 200 as illustrated in FIG. 2C. The discharge liquid 300 that has experienced this state does not tend to connect to the channel liquid 200. In view of this point, the height $T_n$ of the channel 5 is preferably 7 μm or less and the thickness $T_o$ of the orifice plate 3 is preferably 9 μm or less. If the discharge liquid 300 has not experienced such a state where the discharge liquid 300 is separated from the channel liquid 200 by the bubble 301, that is, the discharge liquid 300 remains connected to the channel liquid 200, advantages of the present disclosure can be obtained.

The liquid may be discharged depending on the extent of adjustment of the above-described parameters before the trailing portion 304 moves toward and contacts the heating surface 11. The parameters are properly adjusted so that the trailing portion 304 can contact the heating surface.

The liquid discharge head 12 in the first embodiment includes the channel 5 extending in the x direction symmetrically with respect to the center of gravity of the discharge port 4 in the liquid discharging direction. Consequently, the trailing portion 304 does not tend to contact an edge of the discharge port portion 6 when contacting the heating surface 11 or upon leaving the heating surface 11. Thus, the trailing portion 304 tends to contact only the heating surface 11. If the trailing portion 304 does not contact any portion of the head other than the heating surface 11, the discharge liquid 300 will readily leave the heating surface 11. The liquid discharge head can accordingly have the above-described configuration.

Furthermore, in the liquid discharge head configured such that the center of gravity of the discharge port 4 is aligned with the center of gravity of the heating surface 11 in the liquid discharging direction, the trailing portion 301 does not tend to contact any portion of the head other than the heating surface 11.

As described above, the liquid discharge head 12 may be configured such that the liquid flowing from one direction (channel) is supplied to the discharge port 4. FIGS. 4A-4H are diagrams illustrating steps of liquid discharge in a liquid discharge head according to a modification of the first embodiment. In a state of FIG. 4G, heating the trailing portion 304 through the heating surface 11 generates a bubble in the trailing portion 304, thus increasing the velocity of the trailing portion 304.

For the order of steps in the first embodiment, after the bubble 301 communicates with the atmosphere, the trailing portion 304 contacts the heating surface 11. The time at which the bubble 301 communicates with the atmosphere is not limited to the above-described time. The bubble 301 may communicate with the atmosphere after the trailing portion 304 contacts the heating surface 11 or simultaneously with the contact of the trailing portion 304 with the heating surface 11.

Heater Driving

Figure 3A:
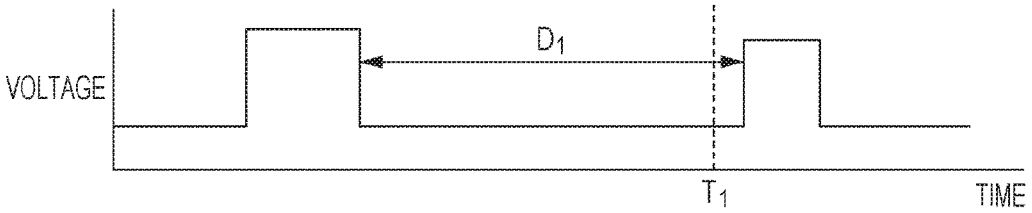
FIGS. 3A-3E are diagrams each illustrating a waveform of a voltage applied to a heater in the first embodiment.

FIG. 3A illustrates a waveform of a voltage applied to the heater 1 in the first embodiment. The trailing portion 304 of the discharge liquid contacts the heating surface 11 at time $T_1$. For one liquid discharge, the voltage to be applied to the heater 1 includes a first rectangular pulse for discharging the liquid and a second rectangular pulse for increasing the velocity of the trailing portion 304 of the liquid. The heater 1 generates first thermal energy in response to the first rectangular pulse and then generates second thermal energy in response to the second rectangular pulse. In the first embodiment, the first rectangular pulse has a pulse width of 0.75 μs and a voltage of 17.6 V and the second rectangular pulse has a pulse width of 0.5 μs and a voltage of 17.6 V. The second rectangular pulse is applied after 2.5 μs from completion of application of the first rectangular pulse. In the first embodiment, the application of the second rectangular pulse is started while the trailing portion 304 of the liquid is in contact with the heating surface 11.

In the liquid discharge method according to the present disclosure, the surface tension of the liquid may cause the trailing portion 304 to be separated from the leading portion 305 (FIG. 2$H_2$). For this reason, the trailing portion 304 is heated so that liquid including the trailing portion 304 catches up with the liquid including the leading portion 305 and the separated liquid droplets merge (FIG. 2I) before the leading portion 305 lands on a printing medium. Thus, satellite droplets can be further reduced.

Figure 3B:
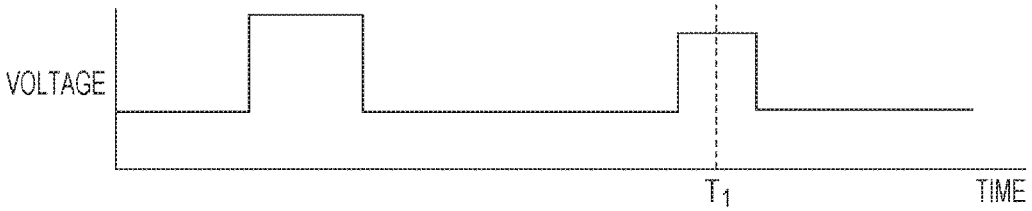
Figure 3C:
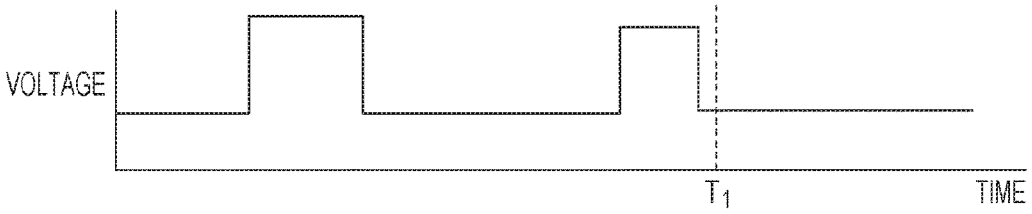
Figure 3D:
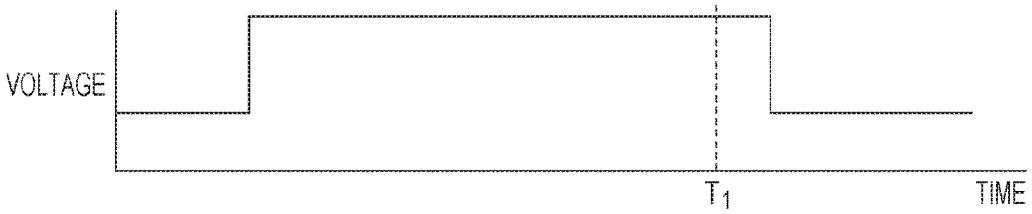
Figure 3E:
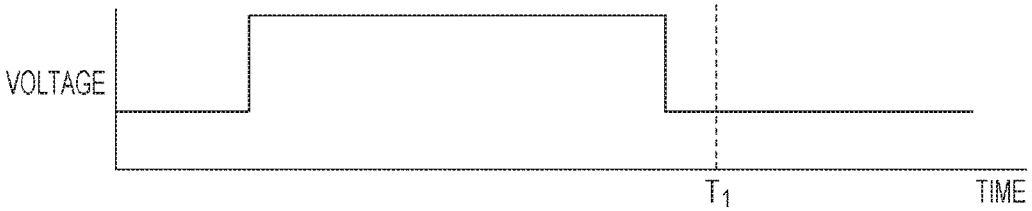

For heater driving, other voltage waveforms, as illustrated in FIGS. 3B-3E, may be used in the first embodiment. FIGS. 3B and 3C illustrate a waveform in which the application of the second rectangular pulse is started before the trailing portion 304 contacts the heating surface 11. FIG. 3C illustrates a waveform in which the application of the second rectangular pulse is completed before the trailing portion 304 contacts the heating surface 11. FIGS. 3D and 3E illustrate a waveform in which the second rectangular pulse is not applied and the first rectangular pulse is used to generate a bubble in the trailing portion 304 in contact with the heating surface 11. In FIG. 3E, the application of the pulse is completed before the trailing portion 304 contacts the heating surface 11.

In view of the durability of the heater, applying different pulses as illustrated in FIGS. 3A-3C, rather than a continuous pulse as illustrated in FIGS. 3D and 3E, can achieve heating for liquid discharge and heating for increasing the velocity of the trailing portion 304.

Furthermore, since the voltage is applied twice to the same heater 1 in the first embodiment, the heating surface 11 in contact with the trailing portion 304 of the liquid has a higher temperature than the heating surface 11 that is not subjected to heating for liquid discharge. For this reason, the second thermal energy can be less than the first thermal energy as in the first embodiment. In addition, application of a pulse for a certain thermal energy level or greater will not contribute to bubble generation upon reheating. The velocity of the trailing portion 304 will not change accordingly. In view of the durability of the heater 1, therefore, thermal energy should not be too large. In view of the durability of the heater, the heater can be driven such that thermal energy generated in response to the second rectangular pulse is 40% to 80% of that generated in response to the first rectangular pulse.

Figure 11:
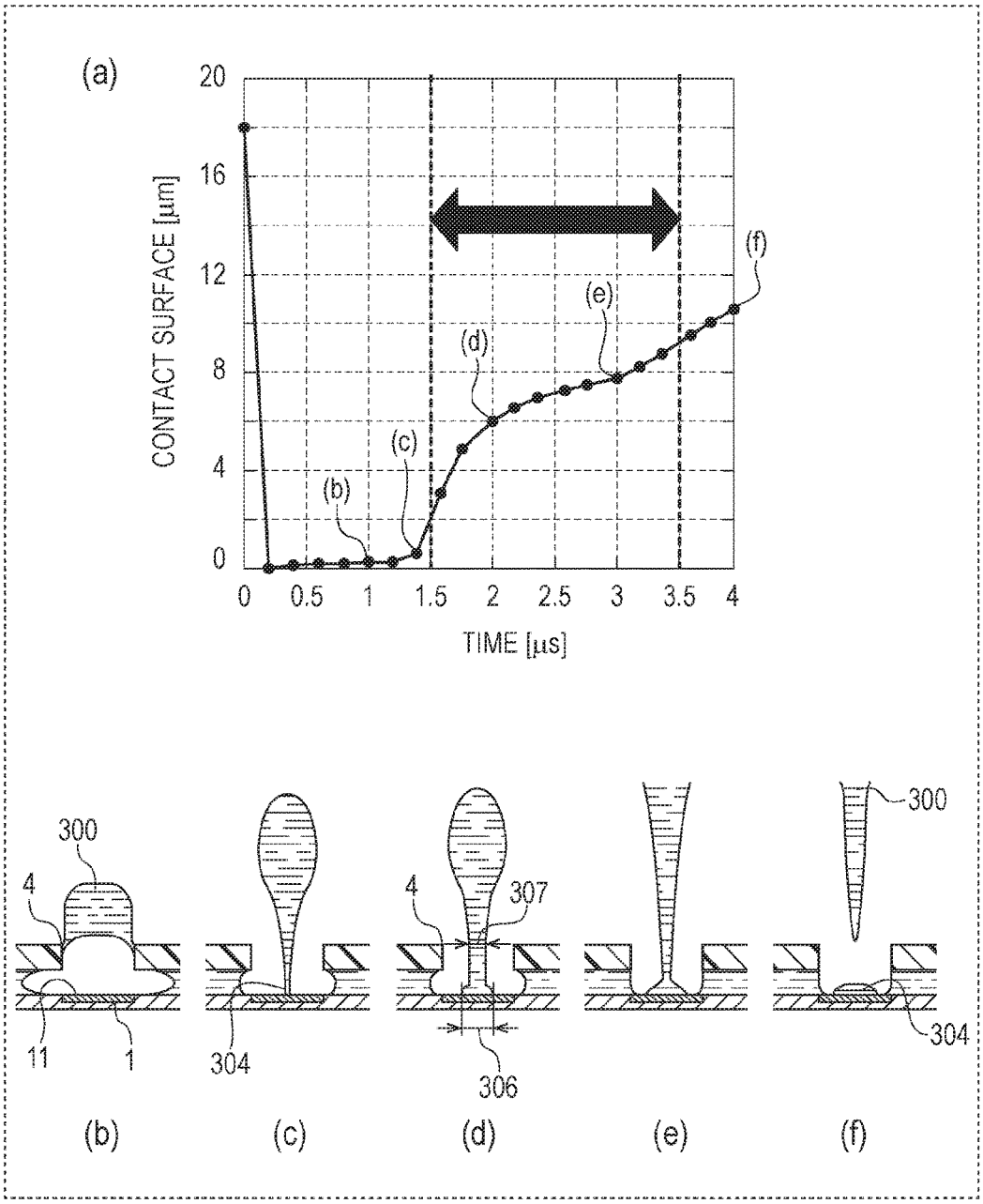
FIG. 11 includes diagrams illustrating proper timing of heater driving in the liquid discharge method according to the present disclosure, (a) being a graph illustrating a change in contact surface of a trailing portion of discharge liquid in contact with a heating surface over time, (b) to (f) being diagrams illustrating states of the discharge liquid.

Driving patterns for the heater 1 have been described above. An example of proper timing of application of the second rectangular pulse will now be described with reference to FIG. 11. FIG. 11(*a*) is a graph illustrating a change in contact surface 306 (FIG. 11(*d*)) of the discharge liquid 300 in contact with the heater (heating surface) over time. FIG. 11(*b*) to (*f*) each illustrate a state of the discharge liquid 300 at corresponding time illustrated in FIG. 11(*a*). Since the discharge liquid and the trailing portion 304 thereof can be regarded as having a substantially circular shape as viewed in a direction orthogonal to the discharge port 4, the contact surface 306 in FIG. 11(*a*) indicates the length of part of the discharge liquid in contact with the heating surface 11 in sectional view.

In the case where the application of the second rectangular pulse is started before time $T_1$, at which the trailing portion 304 of the discharge liquid contacts the heating surface 11, as illustrated in FIGS. 3B and 3C, a bubble tends to be formed, as illustrated in FIG. 11(*b*), in the entire contact surface 306 (FIG. 11(*d*)) of the trailing portion 304 in contact with the heating surface 11. In this case, the bubble in the trailing portion 304 of the discharge liquid may immediately communicate with the atmosphere and enough pressure to press the trailing portion 304 may fail to be obtained. It may therefore be difficult to efficiently increase the velocity of the trailing portion 304 of the liquid. For this reason, the application of the second rectangular pulse can be started after the trailing portion 304 of the discharge liquid contacts the heating surface 11.

Furthermore, as illustrated in FIG. 11(*c*), a small contact surface 306 of the trailing portion 304 of the discharge liquid in contact with the heating surface 11 causes a bubble generated in the trailing portion 304 in response to the second rectangular pulse to have a small area. It may therefore be difficult to efficiently increase the velocity of the trailing portion 304 of the discharge liquid. For this reason, the application of the second rectangular pulse can be started in a state where the trailing portion 304 of the discharge liquid sufficiently spreads over the heating surface 11. The state where the contact surface 306 sufficiently spreads means that the area of the contact surface 306 of the trailing portion 304 of the discharge liquid in contact with the heating surface 11 is greater than the cross-sectional area of a liquid column 307 of the trailing portion 304 as illustrated in FIGS. 11(*d*) and (*e*). The term "cross-section of the liquid column 307" of the trailing portion 304 as used herein refers to a cross-section of the discharge liquid 300 at the discharge port 4 in FIG. 11(*d*).

If the start timing of the application of the second rectangular pulse is delayed, the trailing portion 304 of the liquid may be separated from the discharge liquid 300 (FIG. 11(*f*)). In this case, the trailing portion 304 and the leading portion 305 can be merged by applying the second rectangular pulse. Disadvantageously, the discharge liquid 300, serving as a merged droplet, will be more difficult to behave as a unit than the droplet including the leading portion 305 and the trailing portion 304 connecting to each other. For this reason, the application of the second rectangular pulse can be started while the leading portion 305 of the liquid discharged from the discharge port 4 connects to the trailing portion 304 in contact with the heating surface 11.

In view of the above-described points, specifically, the application of the second rectangular pulse can be started after 1.5 to 3.5 μs from the stop of the application of the first rectangular pulse in the first embodiment. Thus, the velocity of the trailing portion 304 of the liquid can be efficiently increased.

Although the example of proper start timing of the application of the second rectangular pulse has been described above, this timing can be regarded as timing of generation of a bubble in the trailing portion 304. In the first embodiment, two pulses are applied to the heater 1 for one liquid discharge. Each pulse may include a plurality of pulses. Additionally, the shape of each pulse is not limited to a rectangle.

Second Embodiment

A liquid discharge method according to a second embodiment of the present disclosure and a liquid discharge head that can be used for the liquid discharge method will be described with reference to FIGS. 7A-7C. In the first embodiment, the same heater is used to achieve heating for liquid discharge and heating for a trailing portion of liquid in contact with the heating surface. In the second embodiment, different heaters are used for these heating steps. A description of components common to those described in the first embodiment will be omitted unless needed.

Configuration of Liquid Discharge Head

Figure 7A:
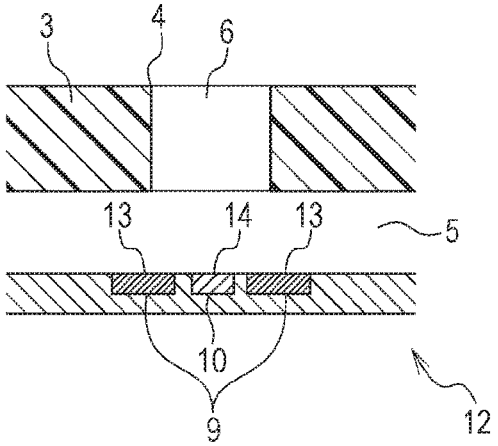
FIGS. 7A-7C are schematic diagrams illustrating a liquid discharge head in a second embodiment to which a liquid discharge method according to the present disclosure can be applied, FIG. 7A being a sectional view of the liquid discharge head, FIG. 7B being a plan view of the head of FIG. 7A, FIG. 70 illustrating wiring lines of heaters.
Figure 7B:
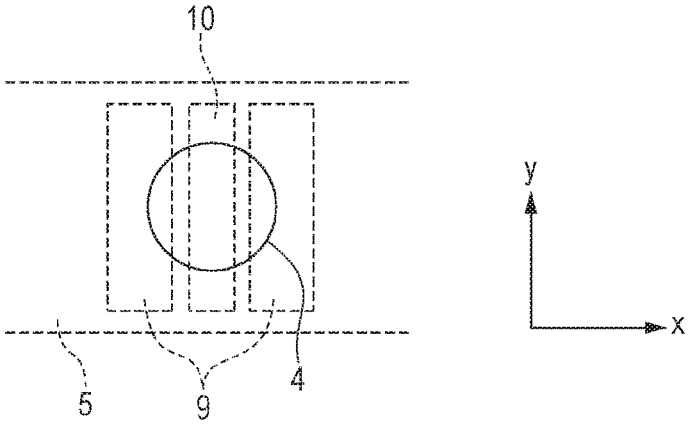
Figure 7C:
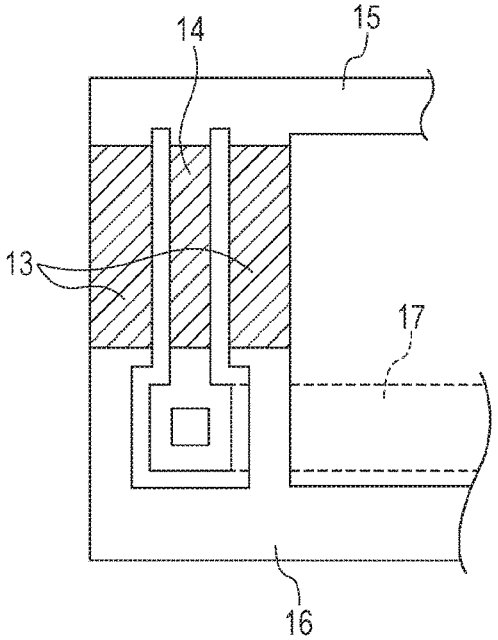
Figure 8A:
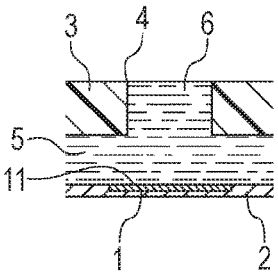
FIGS. 8A-8H are diagrams illustrating steps of liquid discharge in a comparative example.
Figure 8B:
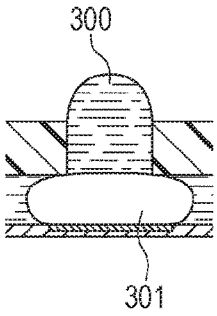
Figure 8C:
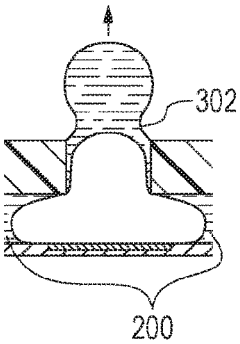
Figure 8D:
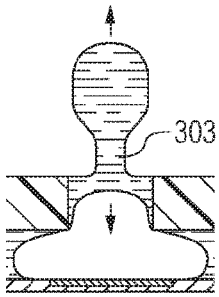
Figure 8E:
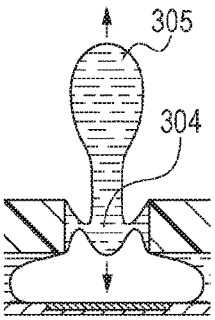
Figure 8F:
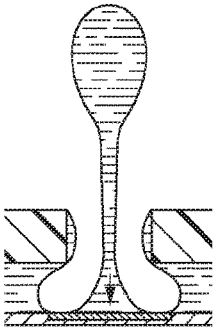
Figure 8G:
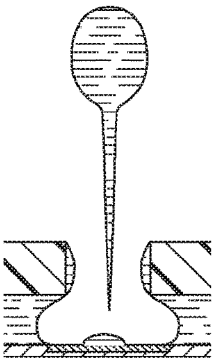
Figure 8H:
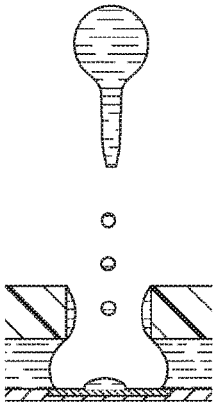

FIGS. 7A-7C are schematic diagrams illustrating an exemplary configuration of the liquid discharge head 12 to which the liquid discharge method according to the present disclosure can be applied. FIG. 7A is a sectional view of the liquid discharge head. FIG. 7B is a plan view of the liquid discharge head as viewed from the side to which the liquid is discharged.

As illustrated in FIGS. 7A and 7B, two discharge heaters 9, each serving as a first heating portion for liquid discharge, are arranged on the element substrate 2 in the second embodiment. In addition, a trailing-portion heater 10, serving as a second heating portion for increasing the velocity of the trailing portion 304 of the liquid, is interposed between the discharge heaters 9. The trailing-portion heater 10 is located such that the center of gravity of the trailing-portion heater 10 is aligned with the center of gravity of the discharge port 4 in the liquid discharging direction. The discharge heaters 9 have an upper surface that is to contact the liquid or that can be covered with a protective film. The upper surface of each discharge heater 9 or the protective film covering the discharge heater 9 serves as a first heating surface 13 for heating the liquid. The trailing-portion heater 10 has an upper surface that is to contact the liquid or that can be covered with a protective film. The upper surface of the trailing-portion heater 10 or the protective film covering the trailing-portion heater 10 serves as a second heating surface 14 for heating the liquid.

FIG. 7C is a wiring diagram of the heaters in the liquid discharge head 12 in the second embodiment. The discharge heaters 9 and the trailing-portion heater 10 are connected to a power supply wiring line 15 connected to a power supply. The discharge heaters 9 are connected to a discharge heater driver (not illustrate), serving as a first driving unit, by a first driver wiring line 16. The trailing-portion heater 10 is connected to a trailing-portion heater driver (not illustrated), serving as a second driving unit, by a second driver wiring line 17. The second driver wiring line 17 extends under the first driver wring line 16 in FIG. 7C.

Liquid Discharge Method

For liquid discharge steps, first, the discharge heater driver applies a pulse to each of the discharge heaters 9 for liquid discharge. Then, the trailing-portion heater driver applies a pulse to the trailing-portion heater 10 while the trailing portion 304 of the discharge liquid moved to the heating surfaces 13 and 14 is in contact with the second heating surface 14. The time at which the pulse is applied to the trailing-portion heater 10 is the same as that in the first embodiment. The pulse may be applied to the trailing-portion heater 10 at any time other than after the trailing portion 304 contacts the second heating surface 14. The application of the pulse may be started or completed before the contact.

While the trailing portion 304 of the liquid is in contact with the second heating surface 14, the trailing portion 304 is heated, thereby generating a bubble. The velocity of the trailing portion 304 of the liquid in the liquid discharging direction can be increased accordingly. This can reduce the difference in velocity between the trailing portion and the main droplet of the liquid, thus reducing the generation of a satellite droplet.

In addition, since the heaters for liquid discharge and the heater for increasing the velocity of the trailing portion 304 are separately arranged in the second embodiment, the pulse width of a driving voltage to be applied to each heater, a driving voltage to be applied to each heater, and the size of each heater can be appropriately selected. This can achieve higher heater efficiency than that in the case where the single heating surface is used for heating for liquid discharge and heating for increasing the velocity of the trailing portion as in the first embodiment. Furthermore, the number of times each heater is driven can be reduced, leading to an increase in durability of the heater.

Since the second heating surface 14 allows the trailing portion 304 to contact it and has only to increase the velocity of the trailing portion 304, the area of the second heating surface 14 should be small in view of the heater efficiency.

Although heating for liquid discharge is performed by using only the first heating surfaces 13 in the second embodiment, this heating step may be performed by using the first heating surfaces 13 and the second heating surface 14. Furthermore, as in the liquid discharge head 12 illustrated in FIGS. 7A and 7B, the use of the channel 5 that extends in the x direction symmetrically with respect to the plane extending in the liquid discharging direction and including the center of gravity of the discharge port 4 facilitates contact between the trailing portion 304 of the liquid and the second heating surface 14. Positioning the second heating surface 14 in the middle between the first heating surfaces 13 further facilitates contact between the trailing portion 304 and the second heating surface 14.

As illustrated in FIG. 7A, each of the first heating surfaces 13 is disposed upstream of the second heating surface 14 in a liquid moving direction in which the liquid is supplied from the channel 5 to the discharge port 4. In such a configuration, a bubble generated by using each first heating surface 13 causes the supplied channel liquid 200 to be less likely to connect to the discharge liquid 300.

The number of first heating surfaces 13, the number of second heating surfaces 14, and the arrangement pattern of the heating surfaces are not limited to those in the second embodiment. It is only required that the first heating surface 13 and the second heating surface 14 are arranged such that the trailing portion 304 of the liquid can contact the second heating surface 14. For example, an arrangement in which the second heating surface 14 is not in the middle between the first heating surfaces 13 or an arrangement in which a single first heating surface 13 and a single second heating surface 14 are parallel to each other may be used.

Third Embodiment

Figure 12:
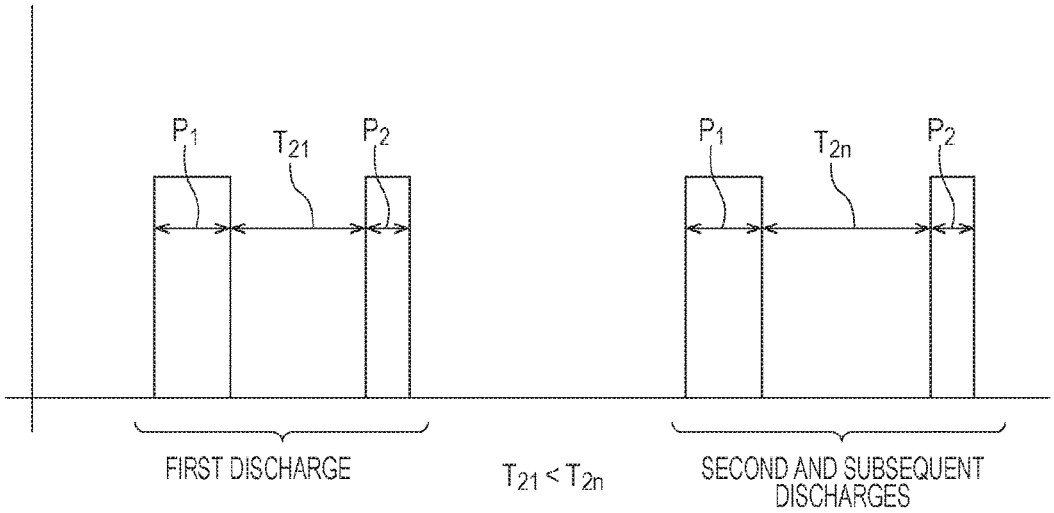
FIG. 12 is a diagram illustrating a waveform of a voltage applied to the heater in a first discharge after an intermission and in subsequent discharges in a third embodiment.

A liquid discharge method according to a third embodiment of the present disclosure will be described with reference to FIG. 12. A feature of the third embodiment is to adjust the timing of the application of the second rectangular pulse in a first discharge after an intermission (e.g., after one or more seconds) such that this timing in the first discharge is different from that in successive liquid discharges. Second and subsequent discharges after the intermission can be regarded as successive discharges. FIG. 12 is a diagram illustrating the waveform of a voltage applied to the heater in the first discharge after the intermission and the second and subsequent discharges in the third embodiment.

Liquid in the first discharge after the intermission has higher viscosity than the liquid in the successive discharges because moisture of the liquid in the first discharge has evaporated. The leading portion (main droplet) 305 of the discharge liquid in the first discharge after the intermission, accordingly, has lower velocity than that in the successive discharges. Furthermore, the trailing portion 304 of the discharge liquid in the first discharge after the intermission has a greater amount than that in the successive discharges. In the first discharge after the intermission, therefore, the trailing portion 304 of the discharge liquid contacts the heating surface 11 and more rapidly spreads over the heating surface 11 than in the successive discharges. Consequently, the trailing portion 304 of the liquid in the first discharge after the intermission tends to merge with the channel liquid 200 (FIG. 2F). Heating the trailing portion 304 of the discharge liquid merged with the channel liquid 200 may cause a new satellite droplet.

In the foregoing first embodiment, the application of the second rectangular pulse can be started after 1.5 to 3.5 μs from the stop of the application of the first rectangular pulse. The above-described conditions are intended for the successive discharges. Considering that the application of the second rectangular pulse in the first discharge after the intermission has to be started before the trailing portion 304 of the discharge liquid merges with the channel liquid 200, a timing range during which the application of the second rectangular pulse can be started may be reduced.

For this reason, the application of the second rectangular pulse in the first discharge after the intermission can be started earlier than that in the successive discharges. Specifically, a time interval $T_{21}$ between the stop of the application of the first rectangular pulse and the start of the application of the second rectangular pulse in the first discharge after the intermission can be less than a time interval $T_{2n}$ between the stop of the application of the first rectangular pulse and the start of the application of the second rectangular pulse in the successive discharges. In each of the first discharge after the intermission and the successive discharges, the application of the second rectangular pulse is started before the trailing portion 304 of the discharge liquid merges with the channel liquid 200.

As described above, the start timing of the application of the second rectangular pulse in the first discharge after the intermission is adjusted such that this timing in the first discharge is different from that in the successive discharges. Such adjustment avoids reducing the timing range, which can be selected in the successive discharges, for the application of the second rectangular pulse. Additionally, this adjustment allows the trailing portion 304 of the discharge liquid on the heating surface 11 just before the application of the second rectangular pulse in the first discharge after the intermission to tend to have the same volume as that in the successive discharges.

The inventors have obtained the following finding by experiment: satellite droplets tended to be generated under conditions where a pulse width. $P_2$ of the second rectangular pulse in the first discharge after the intermission was 50% of a pulse width $P_1$ of the first rectangular pulse and the application of the second rectangular pulse was started after 3.0 μs or more from the stop of the application of the first rectangular pulse. A conceivable reason is that the trailing portion 304 of the discharge liquid was heated in response to the second rectangular pulse after merging of the trailing portion 304 and the channel liquid 200. The set width $P_2$ of the second rectangular pulse equal to 50% of the width $P_1$ of the first rectangular pulse is a lower limit pulse width at which the generation of a satellite droplet can be reduced or eliminated in the successive discharges in a system used in the experiment. In other words, if the width $P_2$ of the second rectangular pulse is less than the lower limit, a satellite droplet may tend to be generated in the successive discharges.

Consequently, the inventors have found that the time interval $T_{21}$ can be selected from a range of 1.5 to 2.5 μs so that the application of the second rectangular pulse in the first discharge after the intermission is started before the trailing portion 304 of the discharge liquid merges with the channel liquid 200. The inventors further have found that the time interval $T_{2n}$ in the second and subsequent discharges can be selected from a range of 1.5 to 3.5 μs. In the above description, the intermission is a period of one or more seconds.

Fourth Embodiment

Figure 13:
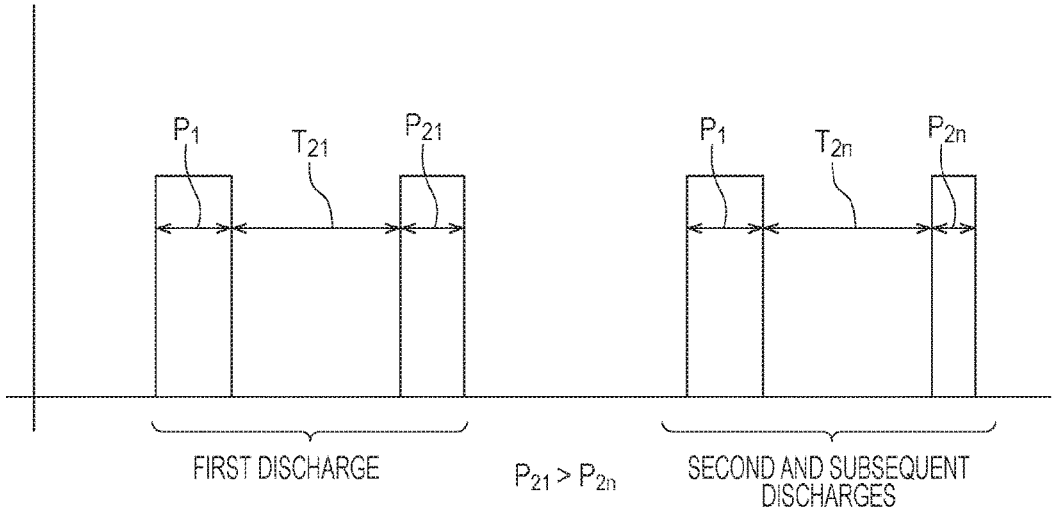
FIG. 13 is a diagram illustrating a waveform of a voltage applied to the heater in a first discharge after an intermission and in subsequent discharges in a fourth embodiment.

A liquid discharge method according to a fourth embodiment of the present disclosure will be described with reference to FIG. 13. FIG. 13 is a diagram illustrating the waveform of a voltage applied to the heater in a first discharge after an intermission and in second and subsequent discharges. As described in the third embodiment, the trailing portion 304 of the discharge liquid tends to merge with the channel liquid 200 in the first discharge after the intermission. Consequently, a new satellite droplet tends to be generated depending on the start timing of the application of the second rectangular pulse. According to the fourth embodiment, thermal energy generated in response to the second rectangular pulse in the first discharge after the intermission is increased by, for example, adjusting the pulse width $P_{21}$ of the second rectangular pulse in the first discharge after the intermission such that the pulse width $P_{21}$ is greater than the pulse width $P_{2n}$ of the second rectangular pulse in the successive discharges. Consequently, sufficient bubble generating energy is applied to the trailing portion 304 of the discharge liquid, thus discharging the liquid. Consequently, the generation of a satellite droplet in the first discharge after the intermission can be reduced or eliminated.

As described above, setting thermal energy generated in response to the second rectangular pulse to 40% to 80% of thermal energy generated in response to the first rectangular pulse is advantageous in view of the durability of the heater. However, if the second rectangular pulse in the first discharge after the intermission is applied such that thermal energy generated in response to the second rectangular pulse is 40% to 60% of thermal energy generated in response to the first rectangular pulse, a satellite droplet would tend to be generated. In contrast, if the second rectangular pulse in the second and subsequent discharges, or the successive discharges is applied such that thermal energy generated in response to the second rectangular pulse in the successive discharges is always equal to 60% to 80% of thermal energy generated in response to the first rectangular pulse as in the first discharge after the intermission, for example, energy consumption may increase or the durability of the heater may degrade.

For this reason, the thermal energy generated in response to the second rectangular pulse in the first discharge after the intermission is adjusted to be greater than that in the successive discharges. Such adjustment can reduce or eliminate The generation of a satellite droplet with consideration given to energy saving and the durability of the heater. Furthermore, this adjustment allows energy per unit volume (or per unit contact area) applied to the trailing portion 304 of the discharge liquid on the heating surface 11 in response to the second rectangular pulse in the first discharge after the intermission to tend to be equal to that in the successive discharges.

The inventors have obtained the following findings by experiment. The time interval $T_{21}$ between the stop of the application of the first rectangular pulse and the start of the application of the second rectangular pulse was 3.0 μs and the pulse width $P_2$ of the second rectangular pulse was set at a constant value ($P_{21}=P_{2n}$) corresponding to 50% of the pulse width $P_1$ of the first rectangular pulse as in the system described in the third embodiment. In this case, a satellite droplet did not tend to be generated in the successive discharges but a satellite droplet tended to be generated in the first discharge after the intermission. For this reason, the pulse width $P_{21}$ of the second rectangular pulse in the first discharge after the intermission was increased to be greater than the pulse width $P_{2n}$ in the successive discharges such that a pulse having a width corresponding to, for example, 60% to 80% of the pulse width $P_1$ was applied. Consequently, the generation of a satellite droplet was reduced or eliminated in the first discharge after the intermission while an increase in energy consumption was being suppressed. In the above description, the intermission is a period of one or more seconds.

Furthermore, thermal energy generated in response to the second rectangular pulse in the first discharge after the intermission can be adjusted such that this energy is different from that in the successive discharges by changing a voltage instead of adjusting the pulse widths such that they are different from each other as in the fourth embodiment, or by both changing the voltage and adjusting the pulse widths such that they are different from each other.

Fifth Embodiment

Figure 14A:
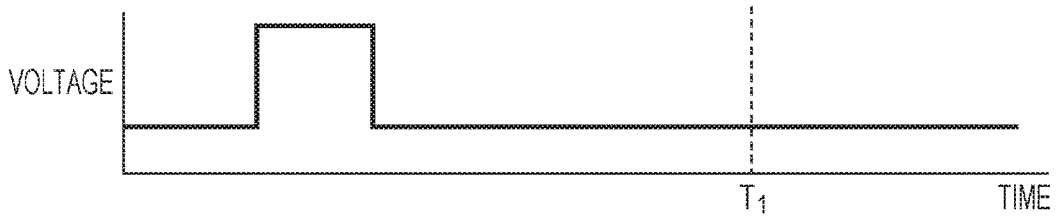
FIGS. 14A-14C are diagrams each illustrating a waveform of a voltage applied to the heater in a preliminary discharge operation.
Figure 14B:
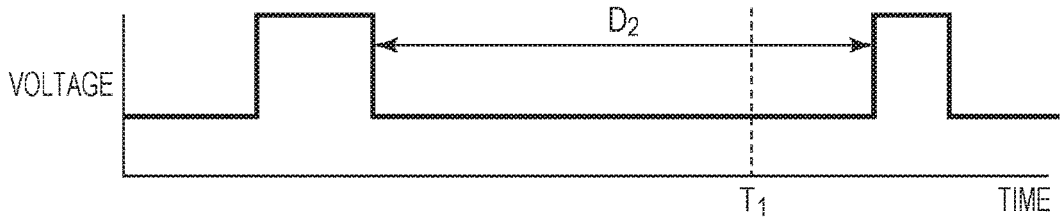
Figure 14C:
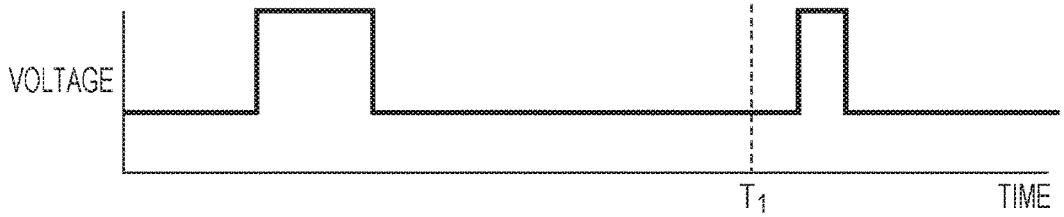
Figure 15:
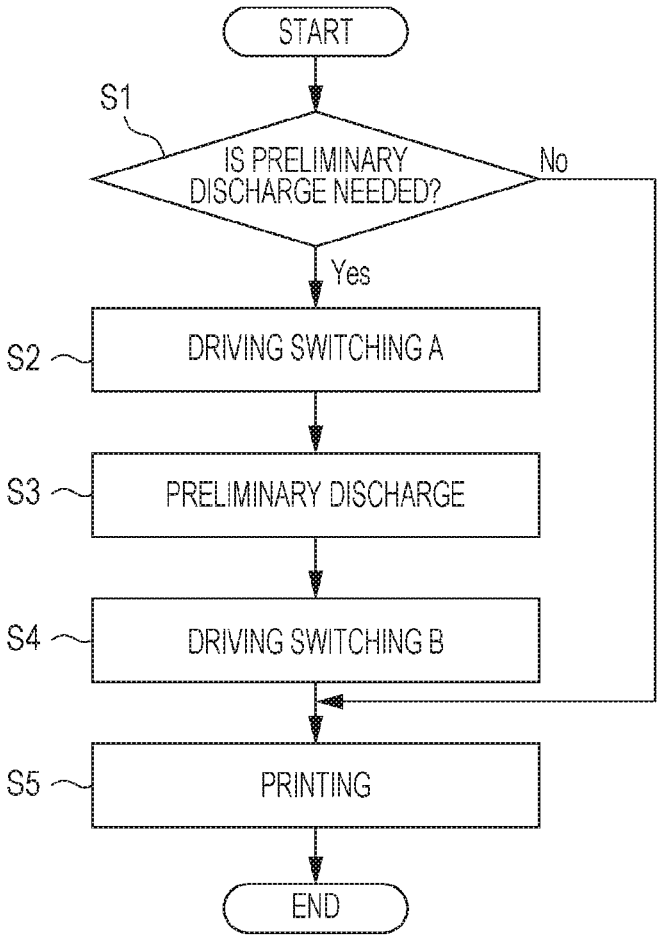
FIG. 15 is a flowchart illustrating an example of discharge driving switching in the liquid discharge apparatus.

A preliminary discharge operation in a fifth embodiment of the present disclosure will be described with reference to FIGS. 14A-14C and 15. FIGS. 14A-14C illustrate pulse waveforms. FIG. 15 illustrates a flowchart of the preliminary discharge operation. If a discharge is started after a predetermined period or more as an intermission period with no discharge, an increase in viscosity of liquid in a discharge port portion may cause a discharge failure, in which the liquid is not discharged despite application of a pulse for liquid discharge.

For this reason, the preliminary discharge operation that does not contribute to printing is performed when a discharge is again started after the predetermined intermission period or more. If pulses are applied as illustrated in FIGS. 3A-3C while the liquid has high viscosity, the following problems will occur. Specifically, if the second rectangular pulse is applied in an undischarged state where the liquid is not discharged, the temperature of the heater may be excessively increased, causing supplied liquid to boil again (hereinafter, also referred to as a "reboiling phenomenon"). Such a reboiling phenomenon may produce a residual bubble. A residual bubble may cause the next bubble to be generated by nucleate boiling with the residual bubble as a nucleus, instead of by film boiling. Unfortunately, power obtained due to bubble generation may decrease, leading to an increase in number of discharges, required to restart printing, in the preliminary discharge operation.

According to the fifth embodiment, as illustrated in FIG. 14A, only the first rectangular pulse is applied and the second rectangular pulse is not applied in the preliminary discharge operation. A liquid discharge apparatus in the fifth embodiment includes the head driver 1705 (FIG. 10), serving as a driving unit operable to apply a pulse to a heater as illustrated in any of FIGS. 3A-3C in a printing operation and apply a pulse illustrated in FIG. 14A the heater in the preliminary discharge operation. Such a configuration can prevent a residual bubble in the preliminary discharge operation and reduce the number of discharges (hereinafter, also referred to as "preliminary discharges") required. Thus, the preliminary discharge operation can be efficiently performed. Furthermore, the printing operation can be started immediately after a discharge intermission.

Specifically, as illustrated in FIG. 15, whether the preliminary discharge operation is needed is determined (S1) because, for example, the predetermined discharge intermission period or more has elapsed. If the preliminary discharge operation is needed, driving switching A in which a pulse application pattern is changed to a pattern illustrated in FIG. 14A is performed (S2) and the preliminary discharge operation is performed (S3). After that, driving switching B in which the pulse application pattern of FIG. 14A is changed to a pulse application pattern illustrated in any of FIGS. 3A-3C is performed (S4) and the printing operation is then performed (S5).

For another pulse application pattern for the heater in the preliminary discharge operation, as illustrated in FIG. 14B, the start of the application of the second rectangular pulse in the preliminary discharge operation is delayed as compared with that in the normal printing operation. Specifically, a time interval $D_2$ between the stop of the application of the first rectangular pulse and the start of the application of the second rectangular pulse in the preliminary discharge operation is adjusted to be longer than a time interval $D_1$ between the stop of the application of the first rectangular pulse and the start of the application of the second rectangular pulse in the printing operation. This is intended to reduce or eliminate an excessive increase in temperature of the heater by applying the second rectangular pulse to the heater in a state where the temperature of the heater increased due to the application of the first rectangular pulse is reduced to some extent. For example, in a case where the time intervals $D_1$ in the normal printing operations in FIGS. 3A-3C ranged from 2.4 to 3.0 μs, when a pulse pattern similar to that in the printing operation was used in a discharge failure state where the liquid failed to be discharged, a residual bubble was observed. When the preliminary discharge operation with the time interval $D_2$ ranging from 3.0 to 4.5 μs was performed, bubble regeneration due to the application of the second rectangular pulse was observed but heat immediately dissipated because an ambient temperature had fallen. Liquid supplied after the application of the second rectangular pulse was not boiled again and a residual bubble was successfully prevented. Furthermore, in a case where the time interval $D_2$ was 10.0 μs, bubble regeneration due to the application of the second rectangular pulse was not observed, liquid supplied after the application of the second rectangular pulse was not boiled again, and a residual bubble was successfully prevented.

FIGS. 16A1-16A5, 16B1-16B5 and 16C1-16C7 illustrate transitions from bubble generation to bubble dissipation in the discharge failure state. Comparison between the pulse application pattern of FIG. 3A used in the discharge failure state and the pulse application patterns of FIGS. 14A and 14B used in the discharge failure state will be described with reference to FIGS. 16A1-16A5, 16B1-16B5 and 16C1-16C7.

FIGS. 16A1-16A5 illustrate a transition from bubble generation to bubble dissipation in the use of the pulse application pattern of FIG. 3A. FIG. 16A2 illustrates a bubble generated due to the application of the first rectangular pulse. FIG. 16A3 illustrates the grown bubble collapsing due to a discharge failure. The second rectangular pulse is applied at the timing before (FIG. 16A4) or immediately after the bubble dissipation. The application of the second rectangular pulse causes the temperature of the heater 1 to excessively rise, causing a reboiling phenomenon. It can be seen, as illustrated in FIG. 16A5, that a residual bubble 310 remains just before the next discharge.

FIGS. 16B1-16B5 illustrate a transition from bubble generation to bubble dissipation in the use of the pulse application pattern of FIG. 14A. Phases illustrated in FIGS. 16B1-16B4 are similar to those in FIGS. 16A1-16A4. Since the second rectangular pulse is not included in the pulse application pattern of FIG. 14A, any residual bubble is not generated as illustrated in FIG. 16B5.

FIGS. 16C1-16C6 illustrate a transition from bubble generation to bubble dissipation in the use of the pulse application pattern of FIG. 14B. Phases illustrated in FIGS. 16C-16C4 are similar to those in FIGS. 16A1-16A4 and those in FIGS. 16B1-16B4. The second rectangular pulse is applied after a phase of FIG. 16C5. In the case where the time interval $D_2$ between the stop of the application of the first rectangular pulse and the start of the application of the second rectangular pulse ranges from 3.0 to 4.5 μs, bubble regeneration 311 occurs as illustrated in FIG. 16C6. After that, however, a reboiling phenomenon is not caused and any residual bubble is not generated as illustrated in FIG. 16C7. In the case where the time interval $D_2$ is 10.0 μs, bubble regeneration as illustrated in FIG. 16C6 does not occur and the same transition as that illustrated in FIGS. 16B1-16B5 is obtained.

For another pulse application pattern for the heater in the preliminary discharge operation, as illustrated in FIG. 14C, the pulse width of the second rectangular pulse in the preliminary discharge operation is reduced such that energy generated in response to the second rectangular pulse in the preliminary discharge operation is less than that in the normal printing operation. For example, the pulse width of the second rectangular pulse in the normal printing operation is adjusted such that energy generated in response to the second rectangular pulse is 40% to 60% of energy generated in response to the first rectangular pulse. In the preliminary discharge operation, the first rectangular pulse is allowed to have almost the same pulse width as that in the printing operation such that almost the same energy as that in the printing operation is generated, and the pulse with of the second rectangular pulse is adjusted such that energy generated in response to the second rectangular pulse is less than or equal to 30% of that generated in response to the first rectangular pulse. Thus, a residual bubble can be prevented.

To reduce energy to be generated, a driving voltage for the second rectangular pulse may be reduced.

Advantages of the preliminary discharge operation with the pulse application patterns illustrated in FIGS. 14A-14C will now be described. The following test was conducted with the liquid discharge head 12, as illustrated in FIGS. 1A and 1B, including the channels 5 having a height $T_n$ of 6 μm, the orifice plate 3 having a thickness $T_o$ of 6 μs, and the discharge ports 4 having a diameter of 19 μm. The head was filled with dye ink and was allowed to discharge the ink. After that, the head was left for 30 seconds such that the head entered the discharge failure state. The number of preliminary discharges required for the head to recover from the discharge failure state and restart the discharge operation (i.e., to enter a dischargeable state) was counted for each of the above-described pulse application patterns used for the discharge operation. For the pulse application pattern of FIG. 3A, about 100 preliminary discharges were required until the head restarted the discharge operation. For the pulse application pattern of FIG. 14A, the head restarted the discharge operation after about 17 preliminary discharges. When the pulse application pattern of FIG. 14B was used and the time interval $D_2$ was 3.5 μs, the head restarted the discharge operation after about 26 preliminary discharges. When the pulse application pattern of FIG. 14C was used and the pulse width of the second rectangular pulse was adjusted such that energy generated in response to the second rectangular pulse was 30% of that generated in response to the first rectangular pulse, the head restarted the discharge operation after about 28 preliminary discharges. As described above, the number of preliminary discharges in the preliminary discharge operation required for the head to recover from the discharge failure state and restart the discharge operation was reduced by using any of the pulse application patterns of FIGS. 14A-14C.

For a discharge port through which discharge is performed infrequently in a printing operation, the discharge port can experience a preliminary discharge such that discharged ink is unnoticed in an image on a printing medium during printing. Such a preliminary discharge can be performed with any of the above-described pulse application patterns of FIGS. 14A-14C.

The liquid discharge apparatus may include a detecting unit capable of detecting a discharge port in the discharge failure state. An exemplary preliminary discharge operation with the detecting unit will now be described with reference to a flowchart of FIG. 17.

Figure 18:
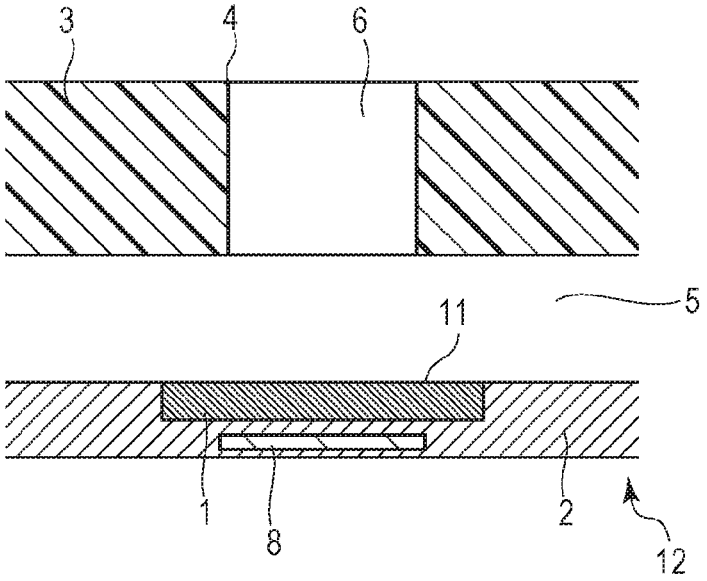
FIG. 18 is a diagram illustrating a liquid discharge head including a temperature sensor, serving as a detecting unit.

Examples of the detecting unit includes a temperature sensor (temperature detecting element) 8 disposed adjacent to or under the heater 1 (on an opposite side of the heater 1 from the heating surface 11) as illustrated in FIG. 18. The sensor 8 is capable of determining, based on the difference in temperature change of the heater 1 between a liquid discharged state and an undischarged state, whether the ink is discharged. The sensor 8 is disposed for each of the heaters 1 in the liquid discharge head. Such a configuration enables a discharge condition of each of the discharge ports to be checked. A discharge port in which a discharge failure has occurred, or in the discharge failure state can be detected.

Figure 17:
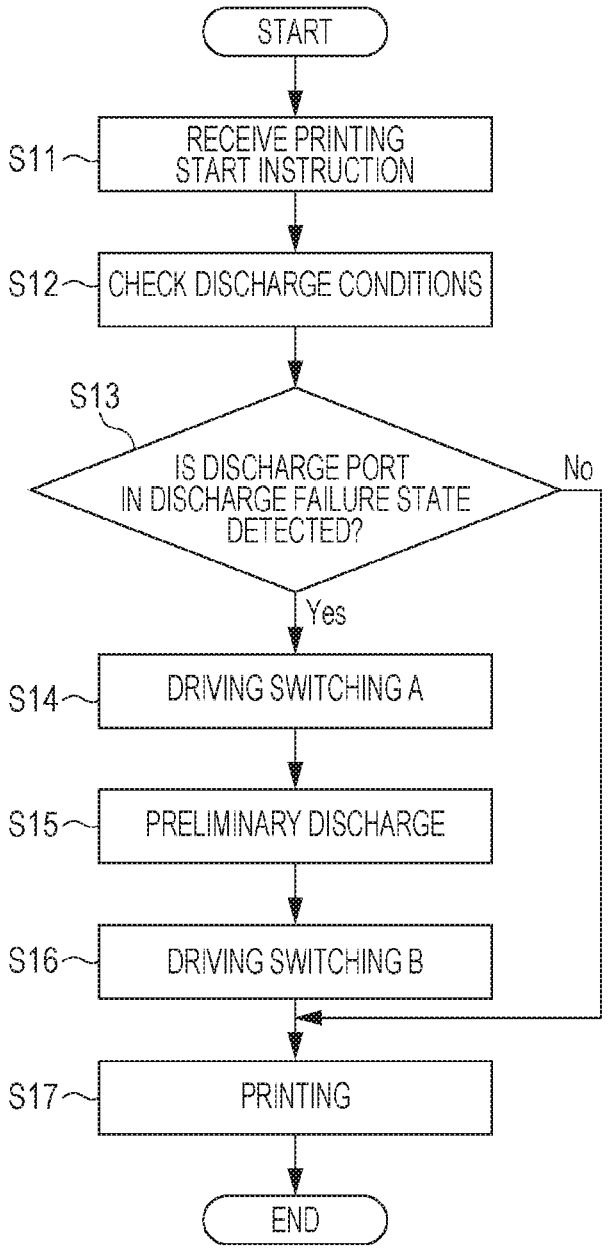
FIG. 17 is a flowchart illustrating another example of discharge driving switching in the liquid discharge apparatus.

Referring to FIG. 17, when a printing start instruction is received (S11), the discharge conditions of the discharge ports are checked by using the temperature sensors 8 in response to the printing start instruction (S12). When a discharge port in the discharge failure state is detected (S13), the driving switching A in which a pulse application pattern is changed to any of the patterns of FIGS. 14A-14C is performed (S14) and the preliminary discharge operation is performed (S15). Pulse application is performed sufficient times so that the discharge port recovers from the discharge failure state to the dischargeable state. After that, the driving switching B in which the pulse application pattern is changed to any of the pulse application patterns of FIGS. 3A-3C is performed (S16). The normal printing operation is then performed (S17). described above, a discharge port in the discharge failure state can be detected, the preliminary discharge operation can be immediately finished, and the normal printing operation can be restarted.

Furthermore, if a discharge failure is overcome and restarting of the discharge operation is detected during the preliminary discharge operation, the pulse application pattern used in the preliminary discharge operation can be changed to any of the patterns of FIGS. 3A-3C. Reducing satellite droplets in the preliminary discharge operation can reduce satellite droplets or mist elected in such an inkjet printing apparatus.

The time at which the discharge conditions are checked is not limited to the above-described example where the discharge conditions are checked at the start of printing. In one or more embodiments, the discharge conditions are checked during the printing operation. When a discharge port in the discharge failure state is detected during the printing operation, the above-described driving switching A (S14) is performed such that a discharge operation for recovery is performed while the printing operation is continued. When it is detected that the discharge condition is recovered to a normal condition, the driving switching B is performed. Then, the normal printing operation is performed.

As described above, the discharge condition of each of the discharge ports can be checked and a discharge port in the discharge failure state can be detected. If a discharge failure in a discharge port A is detected, the printing operation can be performed in a discharge port B, from which any discharge failure is not detected, while the preliminary discharge operation is performed in the discharge port A. In such a case, the entire printing apparatus performs the printing operation. For the respective discharge ports, the discharge port A experiences the preliminary discharge operation and the discharge port B experiences the printing operation. The terms "preliminary discharge operation" and "printing operation" as used herein each refer to an operation in each discharge port, as long as switching between the preliminary discharge operation and the printing operation can be performed for each discharge port.

The term "preliminary discharge operation" as used herein refers to a discharge operation that is performed to overcome a discharge failure in a discharge port and that does not contribute to printing. Examples of the preliminary discharge operation include a discharge operation to be performed at a position where the recovery system unit 89 (FIG. 9) is disposed prior to printing and a discharge operation to be performed on a printing medium such that discharged ink is unnoticed in an image. The term "printing operation" as used herein refers to a discharge operation that is performed based on print data and contributes to printing.

For a unit that checks a discharge condition, any other unit, such as a unit that detects a liquid droplet that is being ejected or a unit that performs determination based on an image formed on a printing medium, can be used.

According to the present disclosure, a trailing portion of liquid that is being discharged from a discharge port is heated through a heating surface while the trailing portion is in contact with the heating surface, thus generating a bubble. The generated bubble presses the trailing portion of the liquid in the liquid discharging direction, so that a satellite droplet does not tend to be generated. As described above, according to the present disclosure, satellite droplets can be further reduced.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-211023 filed Oct. 27, 2016 and No. 2017-016212 filed Jan. 31, 2017, which are hereby incorporated by reference herein in their entirety.

What is claimed is:

1. A liquid discharge method of discharging liquid with a liquid discharge head having a heating surface that contacts and heats the liquid, a discharge port that faces the heating surface and discharges the liquid, and a heating portion configured to generate thermal energy that is used to heat the liquid through the heating surface, the method comprising:

heating, by applying a first voltage pulse to the heating portion, the liquid through the heating surface to generate a first bubble such that the first bubble communicates with an atmosphere, thereby discharging the liquid, wherein the liquid that is being discharged from the discharge port includes a trailing portion, the trailing portion moves toward the heating surface in response to a reduction in volume of the first bubble, and the trailing portion contacts the heating surface; and heating, by applying a second voltage pulse to the heating portion, the trailing portion that is in contact with the heating surface through the heating surface, thereby generating a second bubble.

2. The method according to claim 1, wherein the heating of the trailing portion includes applying the second voltage pulse to the heating portion while the trailing portion is in contact with the heating surface.

3. The method according to claim 1, further comprising:

adjusting a time interval between stop of applying the first voltage pulse and start of applying the second voltage pulse in a first discharge after an intermission, during which a liquid discharge operation is stopped, such that the time interval in the first discharge is less than that in successive discharges.

4. The method according to claim 1, further comprising:

adjusting thermal energy generated by applying the second voltage pulse in a first discharge after an intermission, during which a liquid discharge operation is stopped, such that the thermal energy in the first discharge is greater than that in successive discharges.

5. The method according to claim 1, wherein the trailing portion is heated such that the trailing portion moves faster than a leading portion of the liquid that is being discharged from the discharge port when the trailing portion is caused to leave the heating surface by heating the trailing portion in contact with the heating surface.

6. The method according to claim 1, wherein applying the second voltage pulse to the heating portion is started while the trailing portion is in contact with the heating surface.

7. The method according to claim 1, wherein applying the second voltage pulse to the heating portion is started while an area of contact between the trailing portion and the heating surface is greater than a cross-sectional area of the liquid at the discharge port.

8. The method according to claim 1, wherein applying the second voltage pulse to the heating portion is started while the trailing portion in contact with the heating surface connects to a leading portion of the liquid that is being discharged from the discharge port.

9. The method according to claim 1, wherein the thermal energy generated by applying the second voltage pulse to the heating portion is less than the thermal energy generated by applying the first voltage pulse to the heating portion.

10. A liquid discharge method of discharging liquid with a liquid discharge head having a heating surface that contacts and heats the liquid, a discharge port that faces the heating surface and discharges the liquid, and a heating portion configured to generate thermal energy that is used to heat the liquid through the heating surface, the method comprising:

heating, by applying a first voltage pulse to the heating portion, the liquid through the heating surface to generate a bubble, thereby discharging the liquid from the discharge port; and heating, by applying a second voltage pulse to the heating portion, a trailing portion of the liquid that is being discharged from the discharge port and is in contact with the heating surface through the heating surface, thereby discharging the trailing portion from the discharge port.

11. The method according to claim 10, wherein the heating of the trailing portion includes applying the second voltage pulse to the heating portion while the trailing portion is in contact with the heating surface.

12. The method according to claim 10, further comprising:

adjusting a time interval between stop of applying the first voltage pulse and start of applying the second voltage pulse in a first discharge after an intermission, during which a liquid discharge operation is stopped, such that the time interval in the first discharge is less than that in successive discharges.

13. The method according to claim 10, further comprising:

adjusting thermal energy generated by applying the second voltage pulse in a first discharge after an intermission, during which a liquid discharge operation is stopped, such that the thermal energy in the first discharge is greater than that in successive discharges.

14. The method according to claim 10, wherein applying the second voltage pulse to the heating portion is started while the trailing portion is in contact with the heating surface.

15. The method according to claim 10, wherein the thermal energy generated by applying the second voltage pulse to the heating portion is less than the thermal energy generated by applying the first voltage pulse to the heating portion.

16. A liquid discharge method of discharging liquid with a liquid discharge head having at least one first heating surface and a second heating surface that are arranged parallel to each other and that contact and heat the liquid and a discharge port that faces the at least one first heating surface and the second heating surface and that discharges the liquid, the method comprising:

heating the liquid through at least the at least one first heating surface to generate a bubble such that the bubble communicates with an atmosphere, thereby discharging the liquid, wherein the liquid that is being discharged from the discharge port includes a trailing portion, the trailing portion moves toward the second heating surface in response to a reduction in volume of the bubble, and the trailing portion contacts the second heating surface; and heating the trailing portion through the second heating surface while the trailing portion is in contact with the second heating surface, thereby generating a bubble.

17. The method according to claim 16, wherein the trailing portion is heated such that the trailing portion moves faster than a leading portion of the liquid that is being discharged from the discharge port when the trailing portion is caused to leave the second heating surface by heating the trailing portion in contact with the second heating surface.

18. The method according to claim 16, wherein the liquid discharge head includes a channel for supplying the liquid to the discharge port, the channel extending symmetrically with respect to a plane that extends in a direction in which the liquid is discharged from the discharge port and that includes a center of gravity of the discharge port, and wherein the at least one first heating surface comprises a plurality of first heating surfaces and the second heating surface is interposed between the plurality of first heating surfaces.

19. A liquid discharge method of discharging liquid with a liquid discharge head having a first heating surface and a second heating surface that are arranged parallel to each other and that contact and heat the liquid, and a discharge port that faces the first and second heating surfaces and discharges the liquid, the method comprising:

heating the liquid through at least the first heating surface to generate a bubble, thereby discharging the liquid from the discharge port; and heating a trailing portion of the liquid that is being discharged from the discharge port through the second heating surface while the trailing portion is in contact with the second heating surface, thereby discharging the trailing portion from the discharge port.

20. A liquid discharge apparatus comprising:

a liquid discharge head including a heating portion configured to generate thermal energy, the liquid discharge head having a heating surface to contact liquid and heat the liquid with the thermal energy generated by the heating portion and a discharge port that faces the heating surface and is configured to discharge the liquid; and a driving unit configured to drive the heating portion such that, by applying a first voltage pulse to the heating portion a bubble that causes the liquid to be discharged is generated, and, by applying a second voltage pulse to the heating portion, a trailing portion of the liquid that is being discharged from the discharge port and is in contact with the heating surface is heated through the heating surface to discharge the trailing portion from the discharge port.

21. The liquid discharge apparatus according to claim 20, wherein the driving unit drives the heating portion such that the thermal energy generated by applying the second voltage pulse to the heating portion is less than the thermal energy generated by applying the first voltage pulse to the heating portion.

22. A liquid discharge apparatus comprising:

a liquid discharge head including a first heating portion and a second heating portion, the first and second heating portions being configured to generate thermal energy, the liquid discharge head having a first heating surface to contact liquid and heat the liquid with the thermal energy generated by the first heating portion, a second heating surface to contact the liquid and heat the liquid with the thermal energy generated by the second heating portion, and a discharge port that faces the first and second heating surfaces and that is configured to discharge the liquid;

a first driving unit configured to drive the first heating portion such that the first heating portion generates first thermal energy that is applied to the liquid through the first heating surface to generate a bubble that causes the liquid to be discharged; and a second driving unit configured to drive the second heating portion such that the second heating portion generates second thermal energy that is applied through the second heating surface to a trailing portion of the liquid that is being discharged from the discharge port while the trailing portion is in contact with the second heating surface to discharge the trailing portion from the discharge port.

* * * * *